United States Patent [19]

Cole

[11] 4,160,627

[45] Jul. 10, 1979

[54] HYDRAULICALLY POWERED TRIPLEX PUMP AND CONTROL SYSTEM THEREFOR

[75] Inventor: Clinton W. Cole, Duncan, Okla.

[73] Assignee: Halliburton Company, Duncan, Okla.

[21] Appl. No.: 785,307

[22] Filed: Apr. 6, 1977

Related U.S. Application Data

[60] Continuation of Ser. No. 612,510, Sep. 11, 1975, abandoned, which is a division of Ser. No. 489,763, Jul. 18, 1974, abandoned, which is a division of Ser. No. 406,967, Oct. 16, 1973, Pat. No. 3,847,511.

[51] Int. Cl.[2] ..... F04B 17/00; F04B 35/04

[52] U.S. Cl. ..... 417/403; 251/63.4

[58] Field of Search ..... 417/403, 404, 342, 345, 417/346, 900

[56] References Cited

U.S. PATENT DOCUMENTS

| | | | |
|---|---|---|---|
| 3,650,638 | 3/1972 | Cole | 417/346 |
| 3,773,438 | 11/1973 | Hall et al. | 417/345 |

*Primary Examiner*—Carlton R. Croyle
*Assistant Examiner*—Richard E. Gluck
*Attorney, Agent, or Firm*—John H. Tregoning; James R. Duzan

[57] ABSTRACT

A hydraulically powered triplex pump having at least three pumping units, each operable in a cycle including suction, precompression and discharge phases, with the cycles being out of phase with one another, whereby simultaneous performance of these functions results in a substantially constant pressure and flow of both the pumped fluid and the power fluid. Separate power and cycle control circuits, which may employ different fluids, are provided. Control valve assemblies, each including two sleeve valves communicating with a common chamber, are operated by the control circuit fluid to condition power circuit flow for various phases of the pumping cycle. Precompression valves, a fill valve and a dump valve are operated by the control circuit to provide additional conditioning of power circuit flow to provide the precompression phase and to correct for variations in pumping unit stroke length. A hydraulically operated shut off valve is employed to selectively isolate the multiplex pump from a source of pressurized power fluid. The power end of the pumping units include power cylinders which may be fluid interconnected at their rod ends so that operations in each power cylinder affect operations in the other cylinders.

4 Claims, 20 Drawing Figures

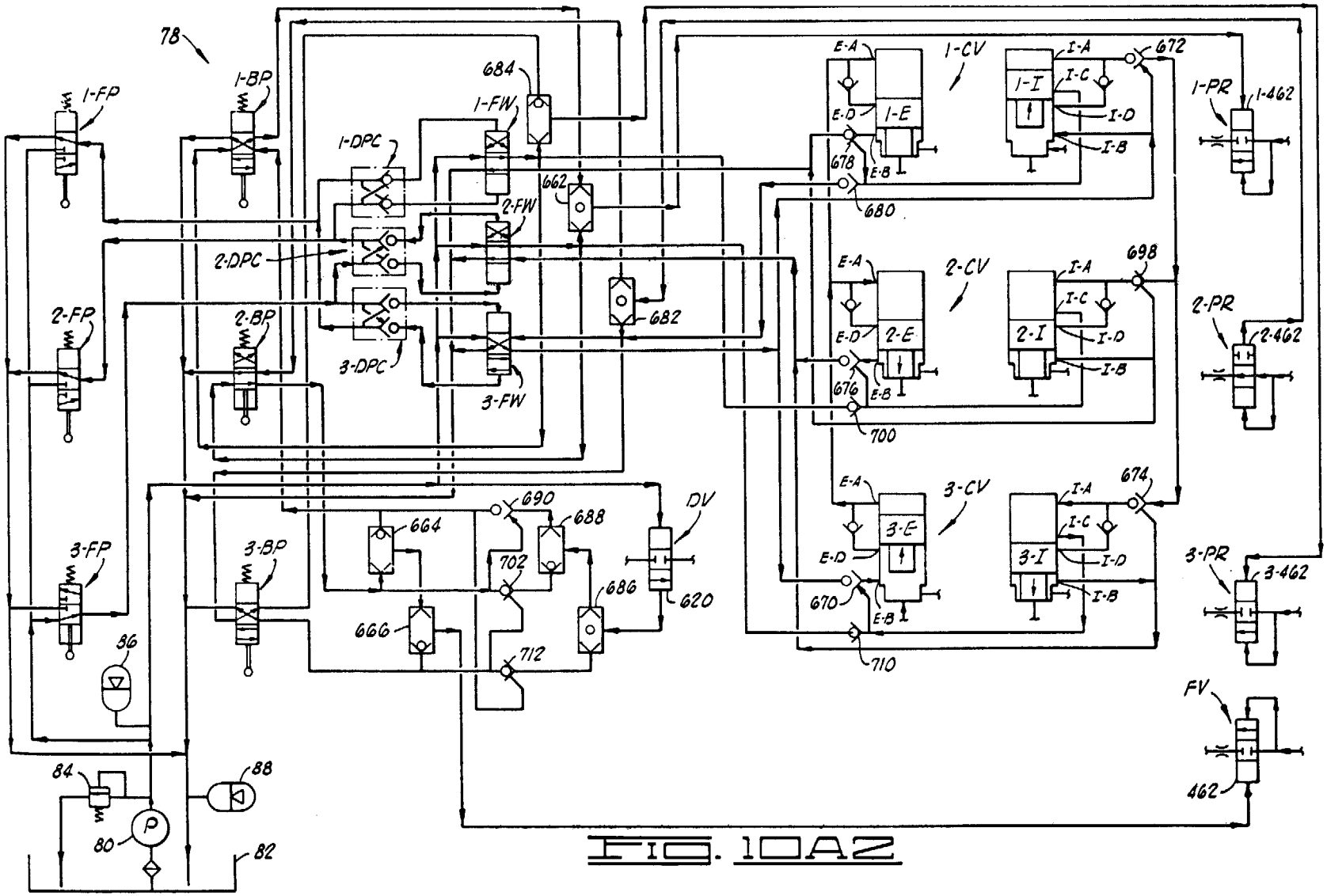
FIG. 10A2

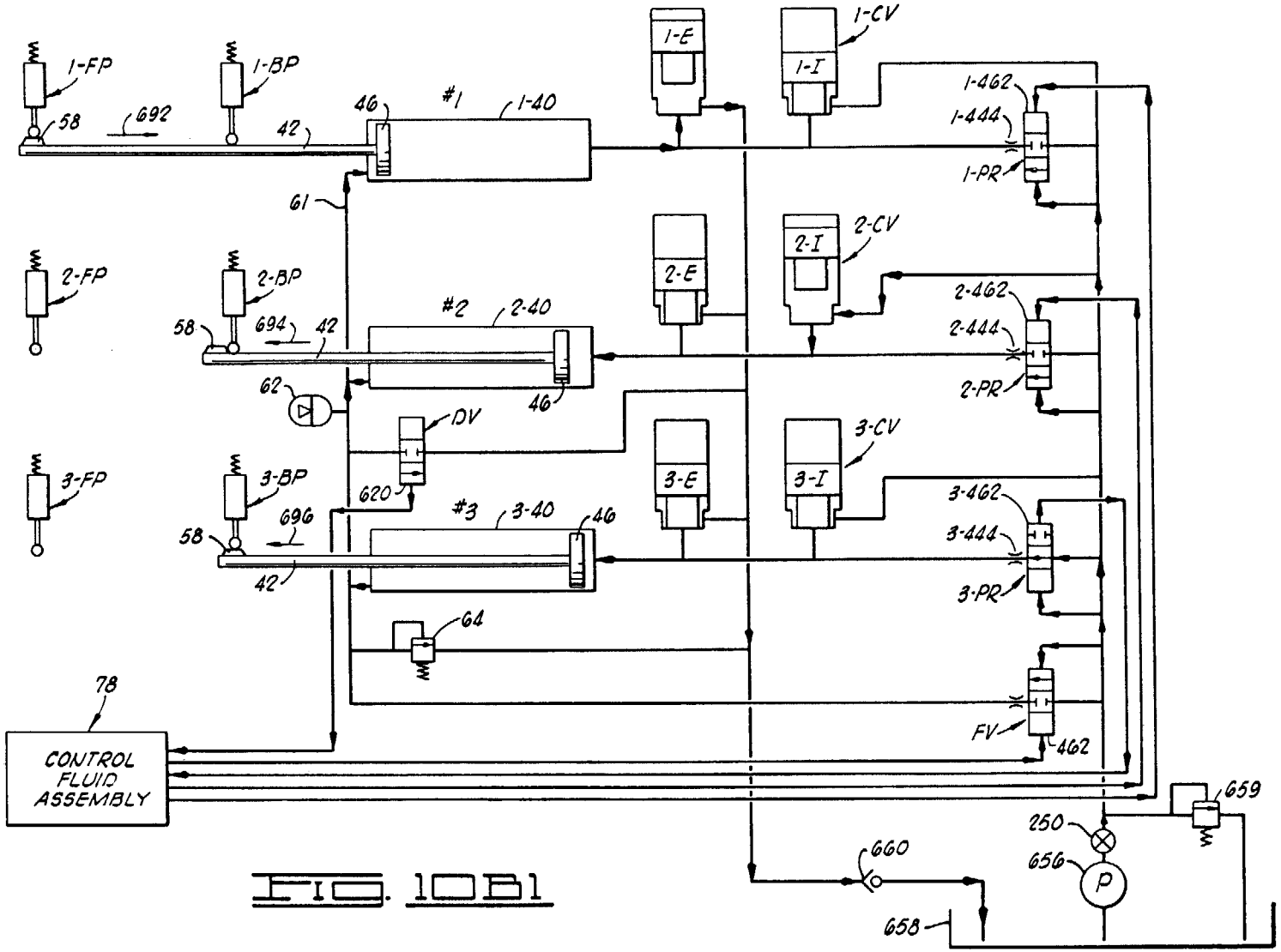
FIG. 10B1

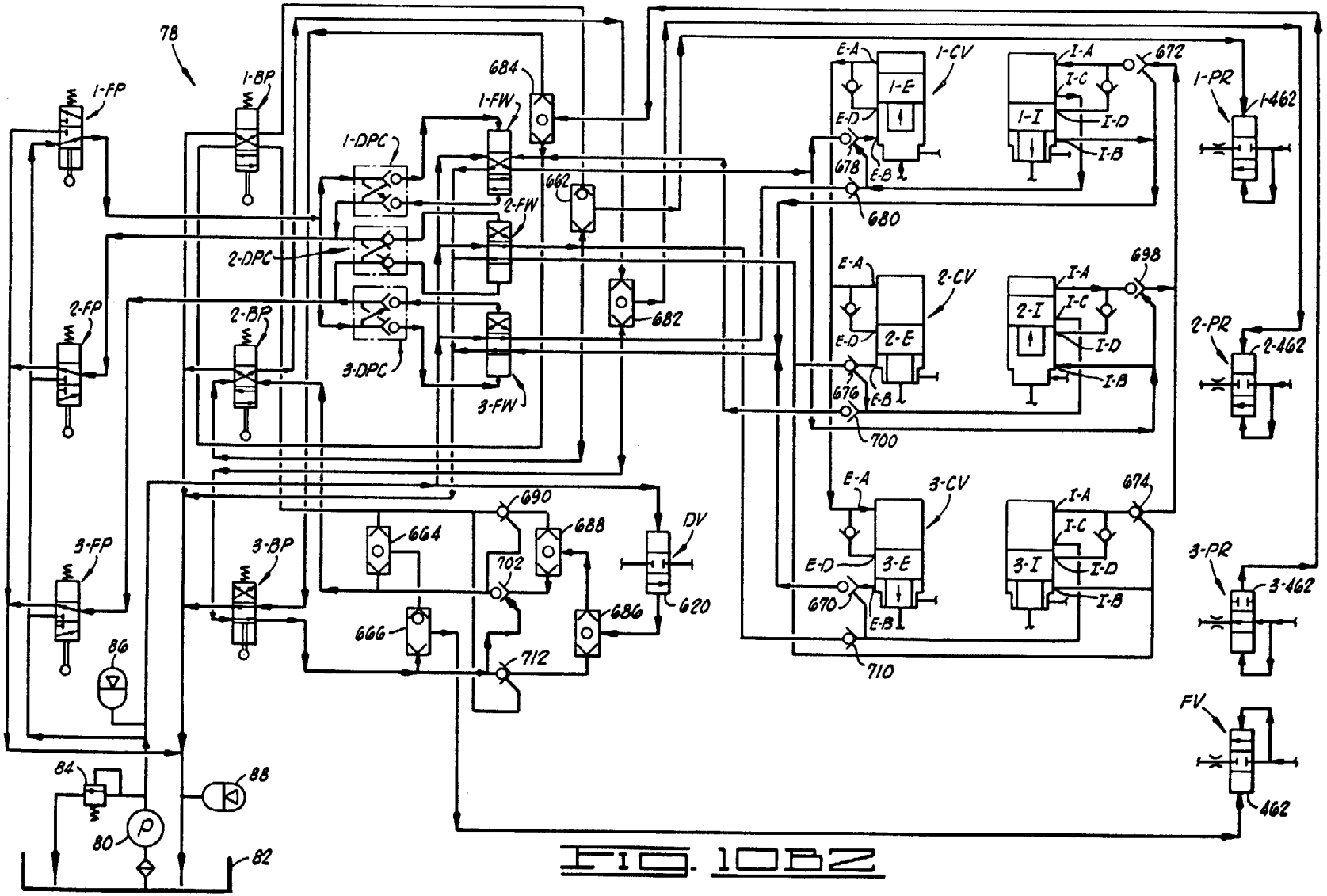
FIG. 10B2

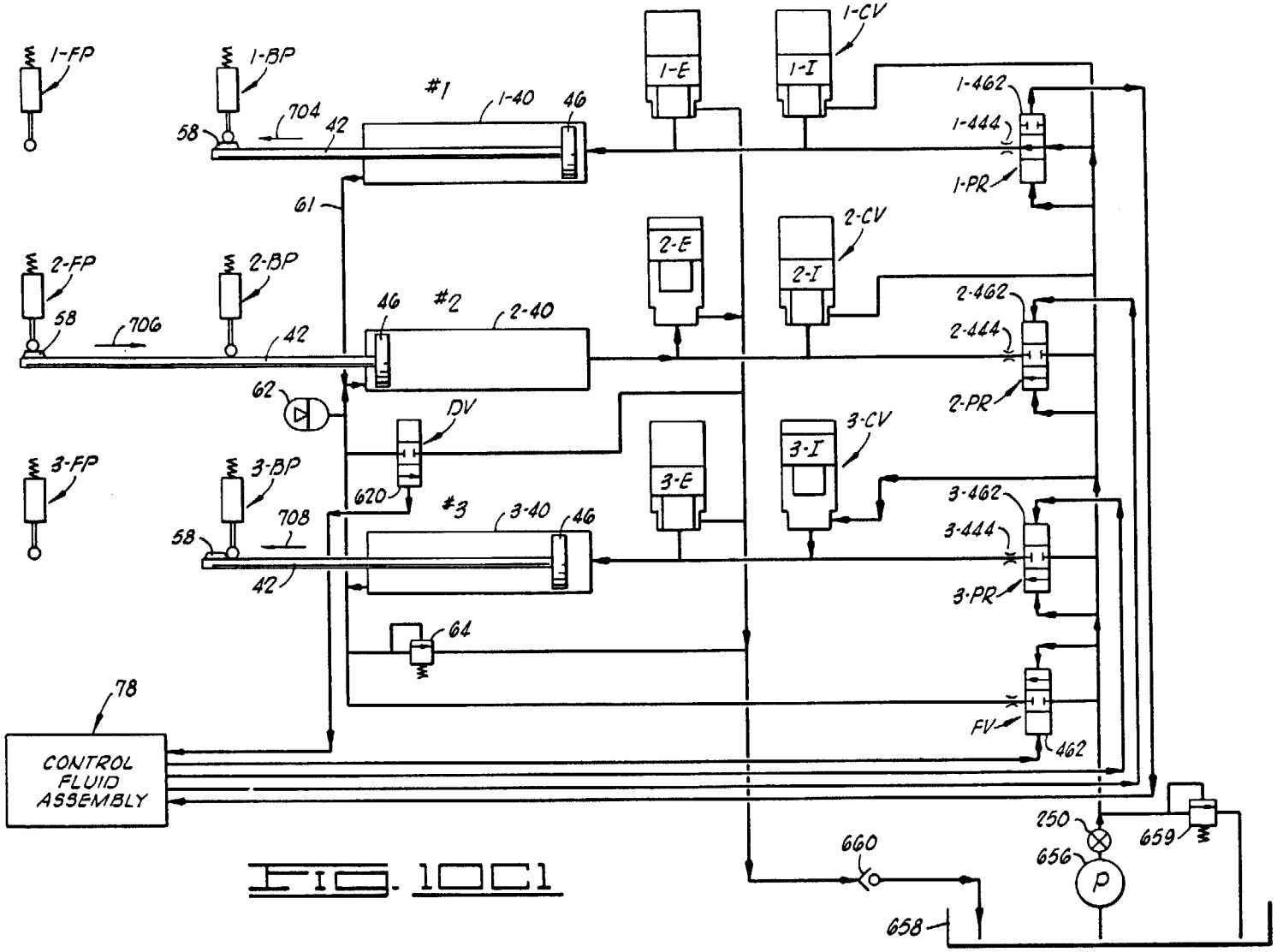
FIG. 10C1

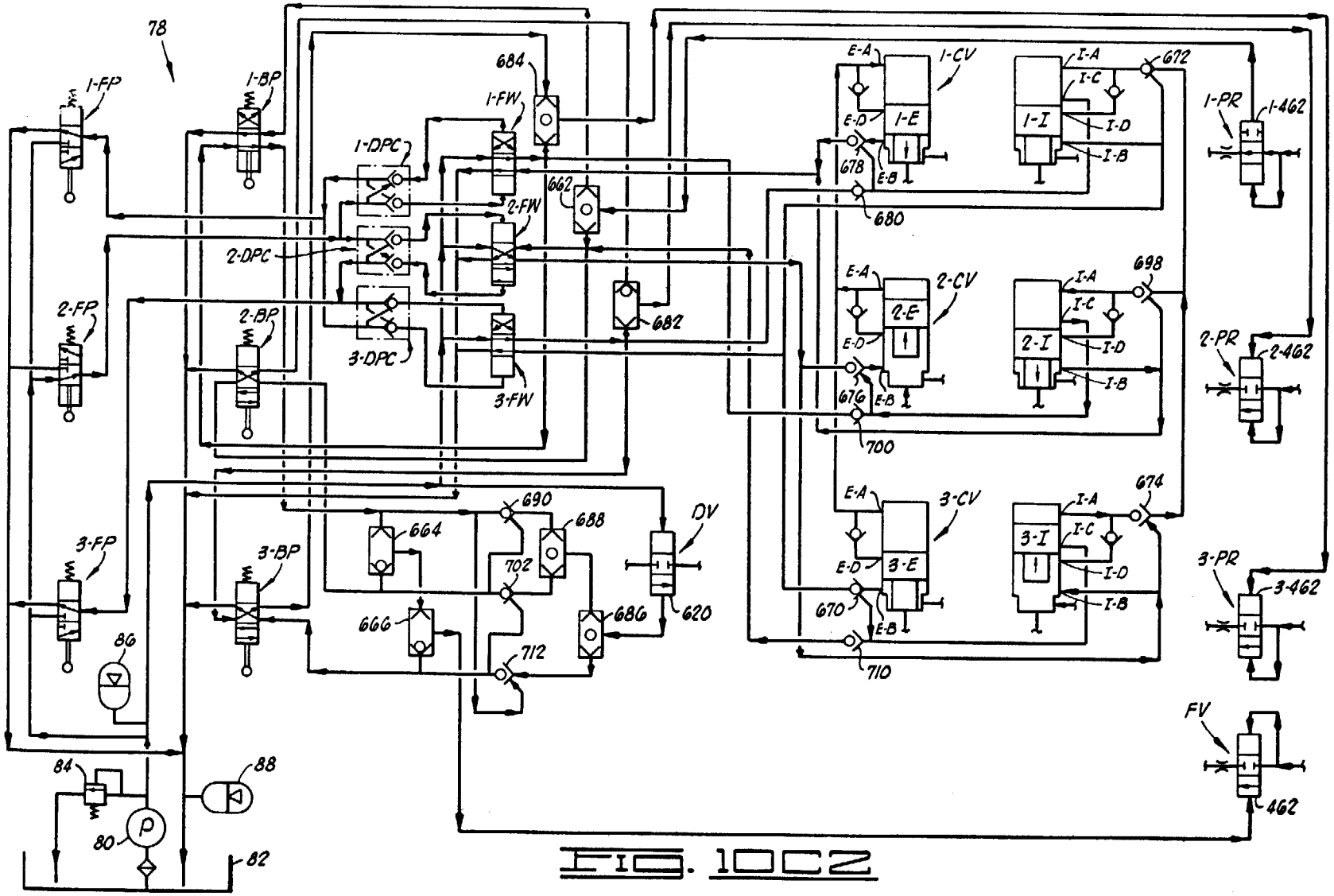
FIG. 10C2

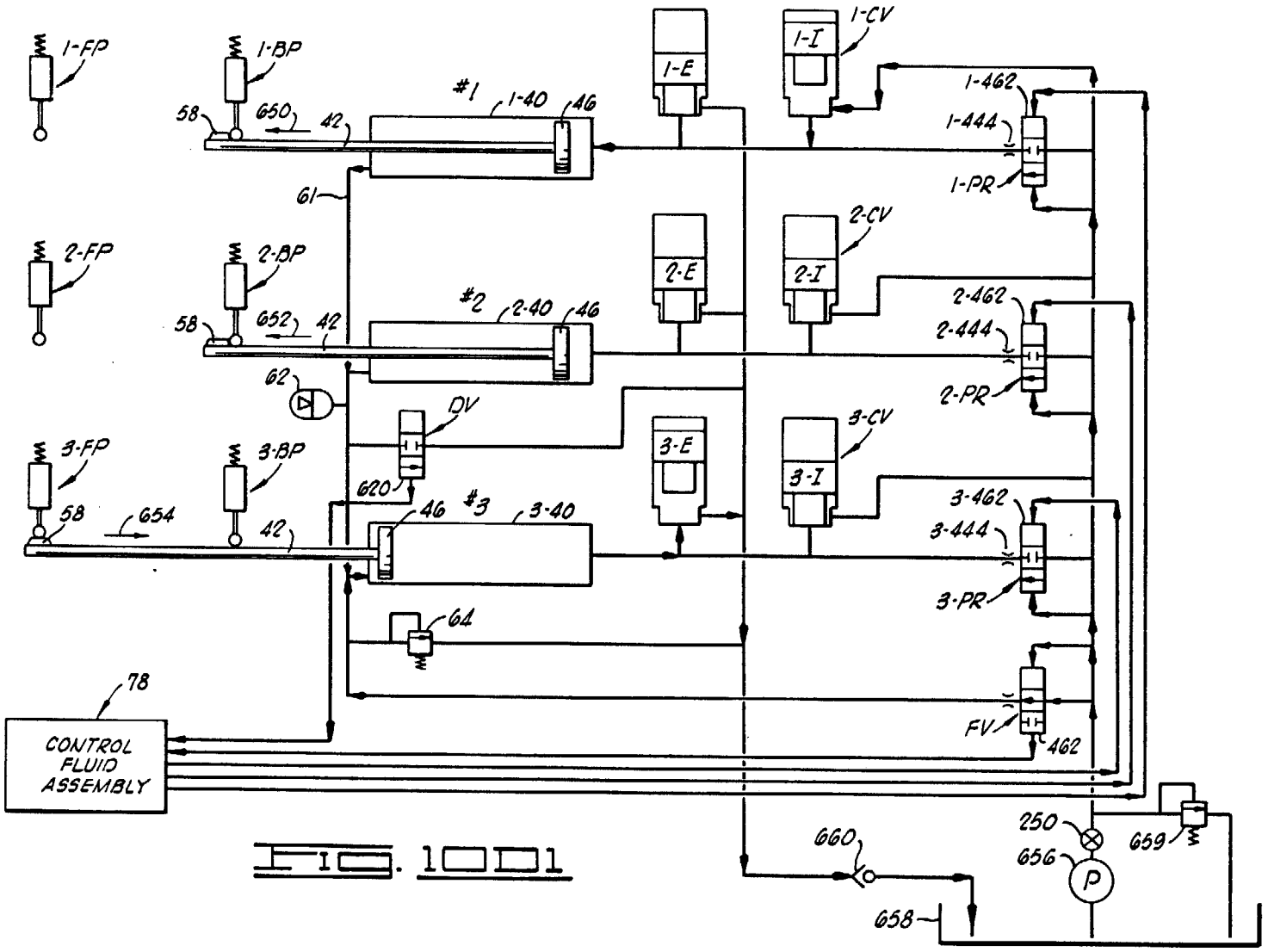
FIG. 10D1

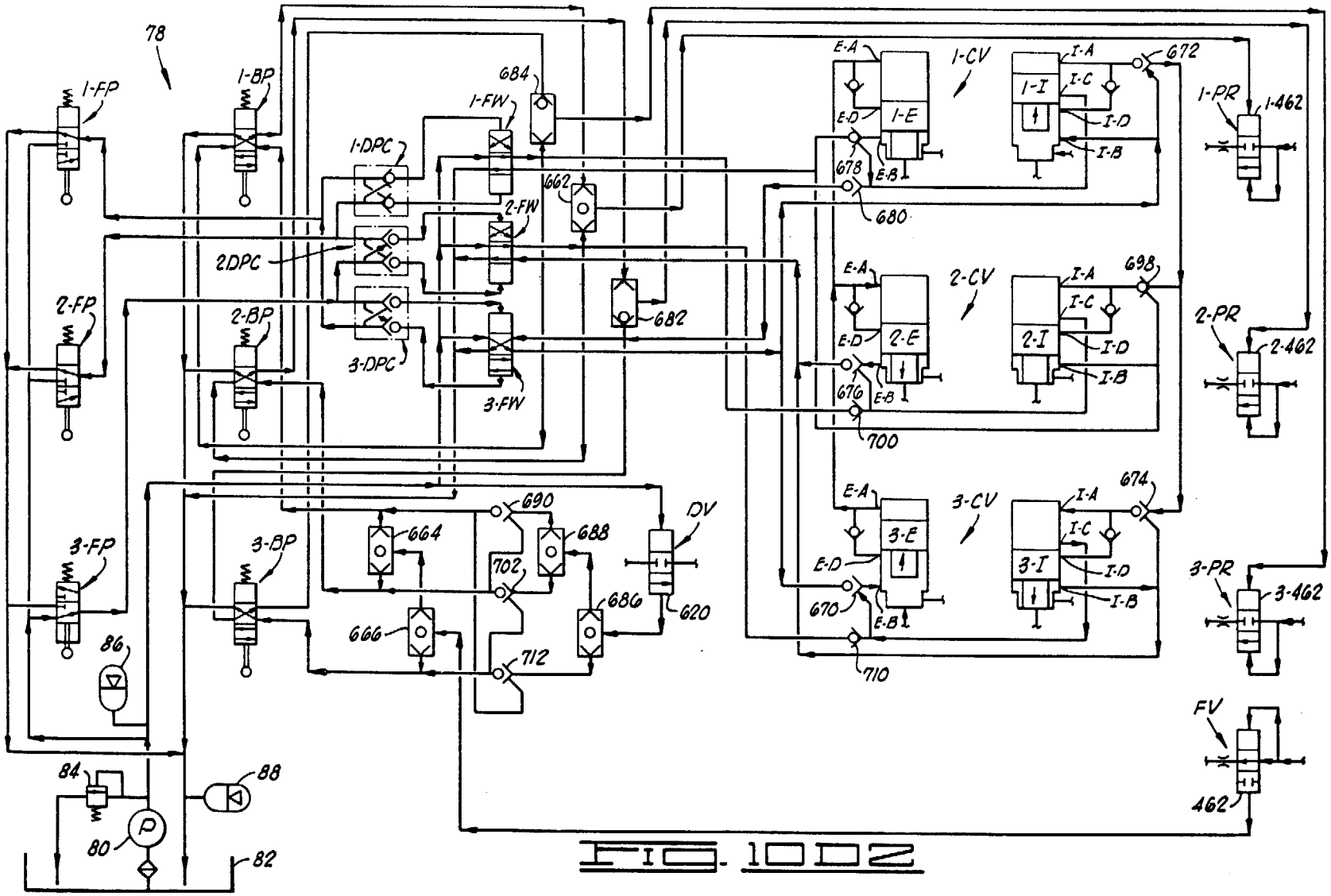
FIG. 10D2

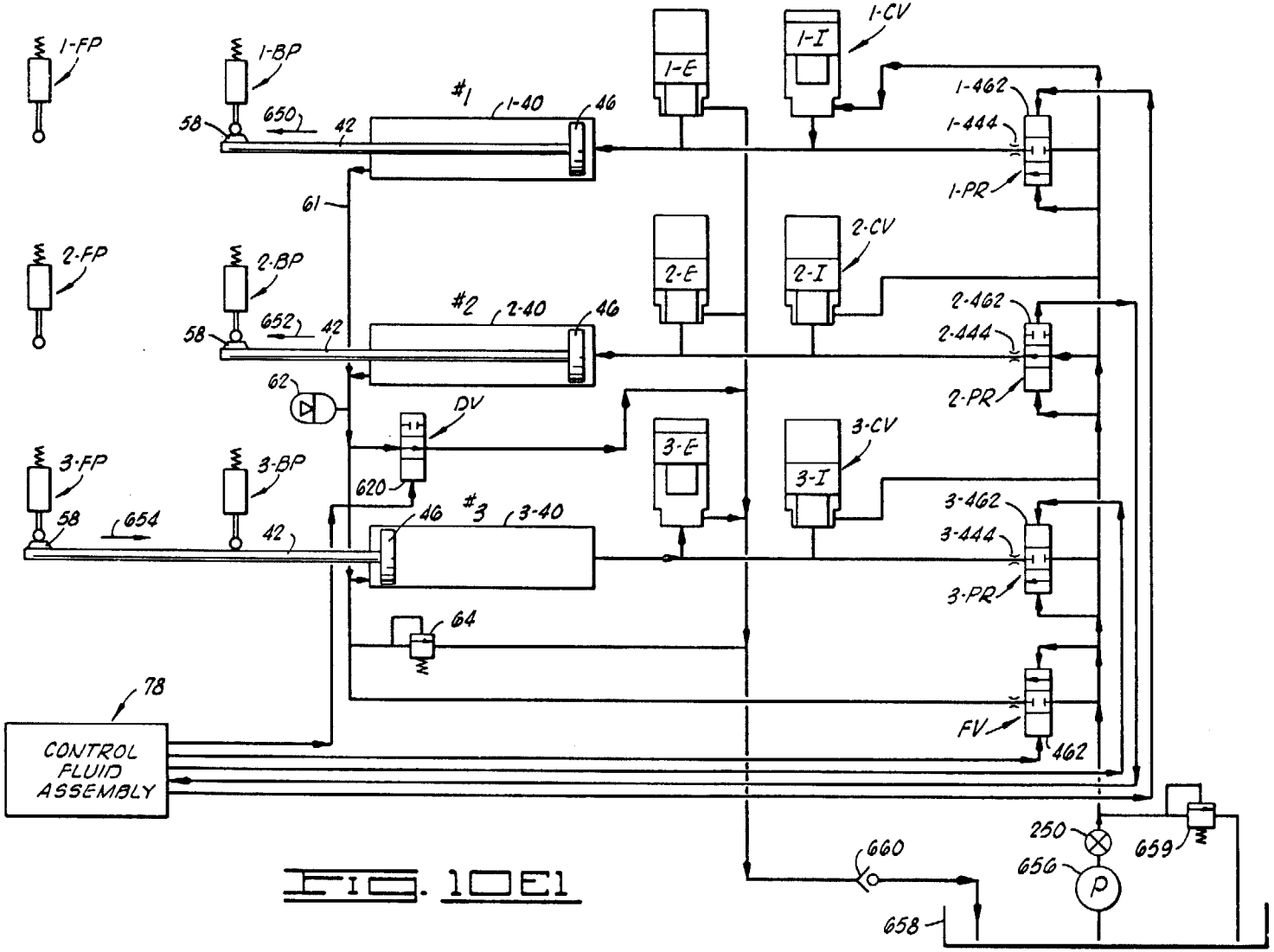
FIG. 10E1

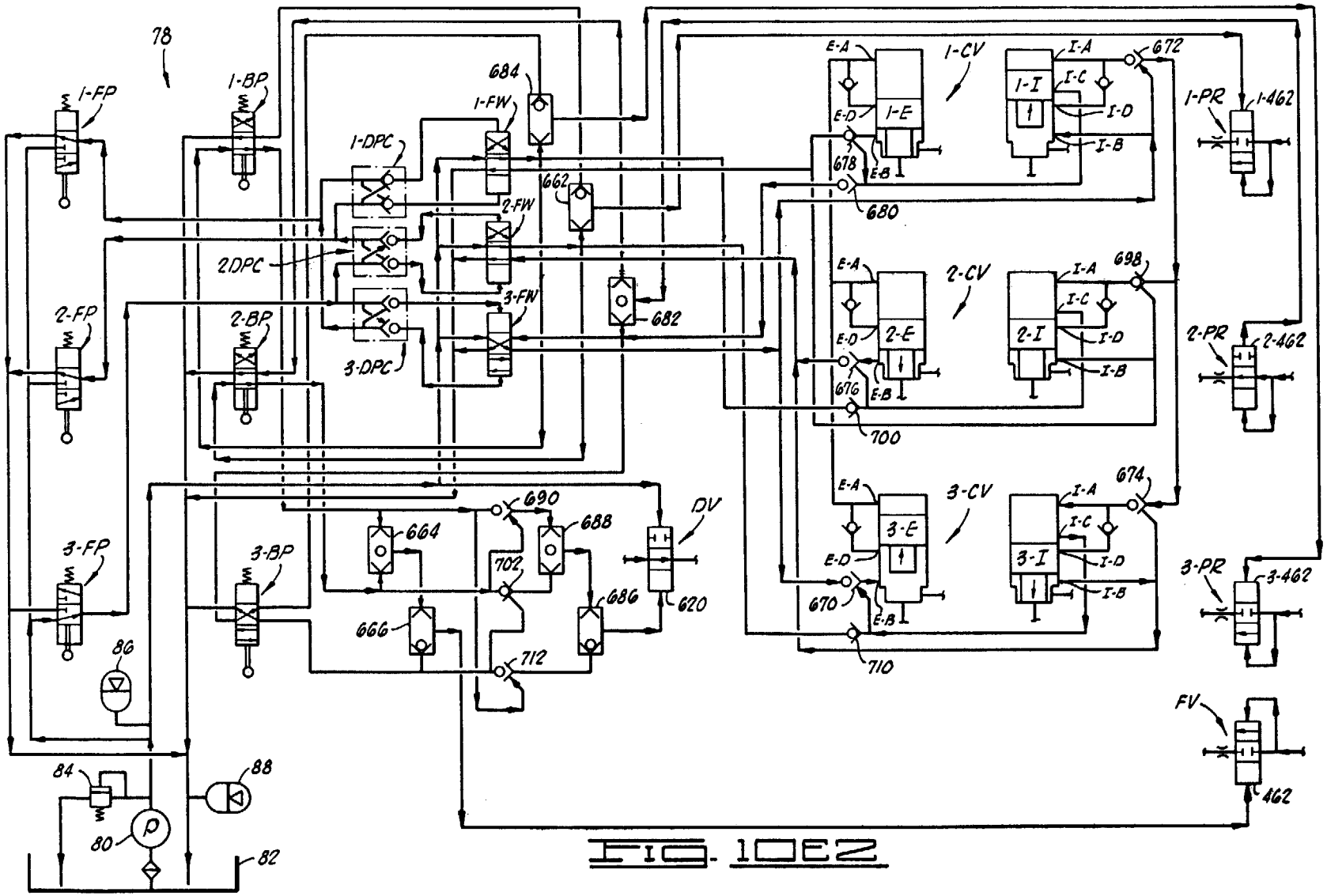
FIG. 10E2

HYDRAULICALLY POWERED TRIPLEX PUMP AND CONTROL SYSTEM THEREFOR

This is a continuation of application Ser. No. 612,510, filed Sept. 11, 1975, now abandoned; which is a Div. of Ser. No. 489,763, filed July 18, 1974, now abandoned; which is a Div. of Ser. No. 406,967, filed Oct. 16, 1973, now U.S. Pat. No. 3,847,511.

BACKGROUND OF THE INVENTION

This invention relates to pumps of the multiplex type. More particularly, but not by way of limitation, this invention relates to a triplex pump of the type in which the pump fluid is precompressed prior to discharge.

In the oil industry it has become common in the past to utilize multiplex pumps designed to deliver pumped fluid at high pressures on the order of 15.000 psi or greater. It has been found that even the slight compressibility of relatively incompressible pumped liquid medium may result in pulsating discharge pressure conditions since a portion of the power intended to accomplish the discharge phase of each pumping cycle is inherently utilized to first compress the liquid medium before it is brought to discharge pressure.

This discharge pattern is particularly undesirable where both high pumping pressure levels and very high delivery volumes are involved. The resulting pulsations could, under such conditions, subject the discharge conduits to severe vibrational forces. Thus, the pumping unit would be subject to stress conditions which might cause failure.

A significant advance in hydraulically powered triplex pumps has been disclosed in U.S. Pat. No. 3,650,638, entitled "Hydraulically Powered Pump Having a Precompression Function" and issued to Clinton W. Cole on Mar. 21, 1972. This patent is assigned to the assignee of the present invention.

SUMMARY OF THE INVENTION

The present invention contemplates an improved hydraulically powered pump employing an improved control system which constantly monitors the operation of the pump during each phase of the pumping cycle to immediately correct any variations from optimum operating conditions.

An object of the invention is to provide an improved triplex pump having a precompression function.

Another object of the invention is to provide a hydraulically powered triplex pump which provides nonpulsating suction flow as well as discharge flow.

A further object of the invention is to provide a fluid operated triplex pump and control system therefor which provides constant monitoring of the functioning of the pump and correction of variations from optimum operating conditions during each phase of the pumping cycle.

A still further object of the invention is to provide improved fluid controlled valving for the operation and control of a hydraulically powered triplex pump.

Still another object of the invention is to provide an improved hydraulically powered triplex pump having high volume and pressure capabilities which is readily mobile and economical in construction and operation.

The preferred embodiment of the invention comprises a hydraulically powered triplex pump having at least three pumping units each operable in a cycle including suction, precompression and discharge phases, with the cycles of each unit being out of phase with one another. The fluid end of the pump terminates in a common discharge line which is in fluid communication with the discharge end of each pumping unit. Likewise, the suction ends of each of the pumping units are in communication with a common suction line.

Operation of the pump according to the described cycle insures simultaneous performance of all functions associated with a given cycle to the end that constant pressure and flow of the pumped fluid occurs in the common suction line and in the common discharge line.

Each pumping unit is fluid operated by power fluid acting on a piston rod assembly extending between the fluid end and a power cylinder assembly at the power end of that unit. Each power cylinder assembly is connected through a control valve assembly to a common flow line communicating with a source of pressurized power fluid and a second common flow line communicating with a power fluid reservoir. By simultaneous performance of the suction, precompression and discharge phases of the cycle, a substantially constant pressure flow of the power fluid to and from these common flow lines is provided.

The control valve assemblies each include two sleeve valves communicating with a common chamber, which in turn communicates with a power cylinder. When one sleeve valve of a given control valve assembly is in an open position and the other is closed, pressurized power fluid enters the associated power cylinder assembly to provide a discharge function in the fluid end of the associated fluid end cylinder assembly. When the sleeve valves are in a reversed position, a suction function is permitted resulting in discharge of the power fluid in the power cylinder assembly to the power fluid reservoir. During a phase of the cycle when both of these sleeve valves are in their closed positions, a precompression valve is opened, and power fluid is directed to the power cylinder through the precompression valve.

A separate control circuit is utilized to move the sleeve valves to their desired positions.

The rod ends of the power cylinders are fluid interconnected so that the functions in each pumping unit are performed in response to those performed in the other units. Also, a portion of the power circuit is interrelated with the control circuit to provide for self-correction of the stroke lengths in the power cylinder assemblies in response to control signals provided by the control circuit which constantly monitors the operation of the three pumping units throughout each phase of the pumping cycle.

Other objects and advantages of the invention will be evident from the following detailed description when read in conjunction with the accompanying drawings.

BRIEF DESCRIPTION OF THE DRAWINGS

FIG. 6 is a cross-sectional view of one precompression valve.

FIG. 9A is an enlarged partial cross-sectional view illustrating valve seat construction of the shut off valve of FIG. 9.

FIGS. 10A1, 10B1 and 10C1 are schematic illustrations depicting the control valve conditions, the power circuit flow and the power cylinder assembly functions respectively associated with the first, second and third phases of the pumping cycle.

FIGS. 10D1 and 10E1 are schematic illustrations depicting the control valve conditions, the power circuit fluid flow and the power cylinder assembly functions respectively associated with first and second variations in the operating conditions illustrated in FIG. 10A1.

FIGS. 10A2, 10B2, 10C2, 10D2, and 10E2 are schematic illustrations showing the positions of the control circuit conditioning valves. The resulting movement of the control valves and the control circuit fluid flow which accomplish the control valve movement and the actuation of the precompression, fill and dump valves in the phases of the pumping cycle respectively associated with FIGS. 10A1, 10B1, 10C1, 10D1 and 10E1.

DETAILED DESCRIPTION

Figure 1:
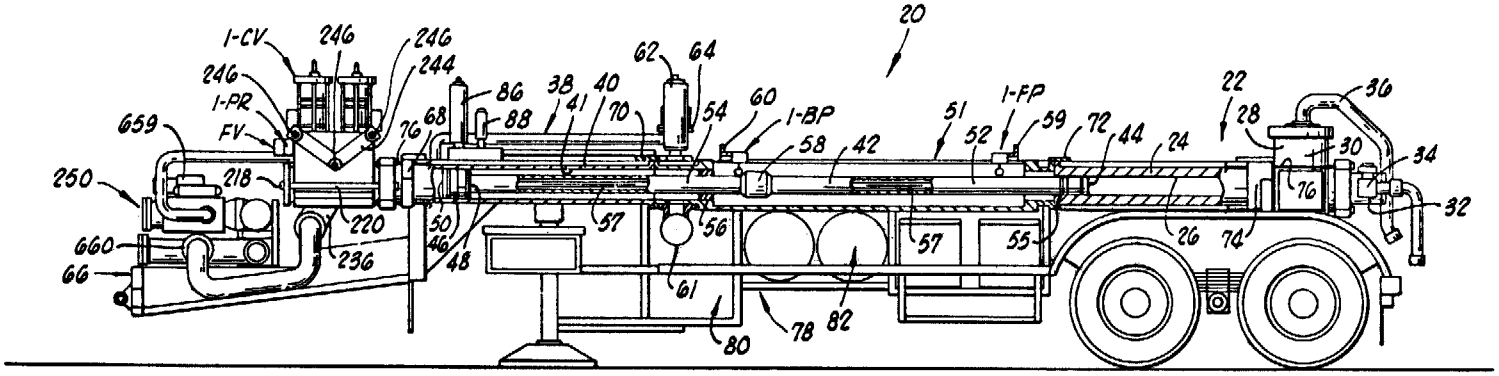
FIG. 1 is a side elevational view partially broken away of a triplex pump according to the present invention.
Figure 2:
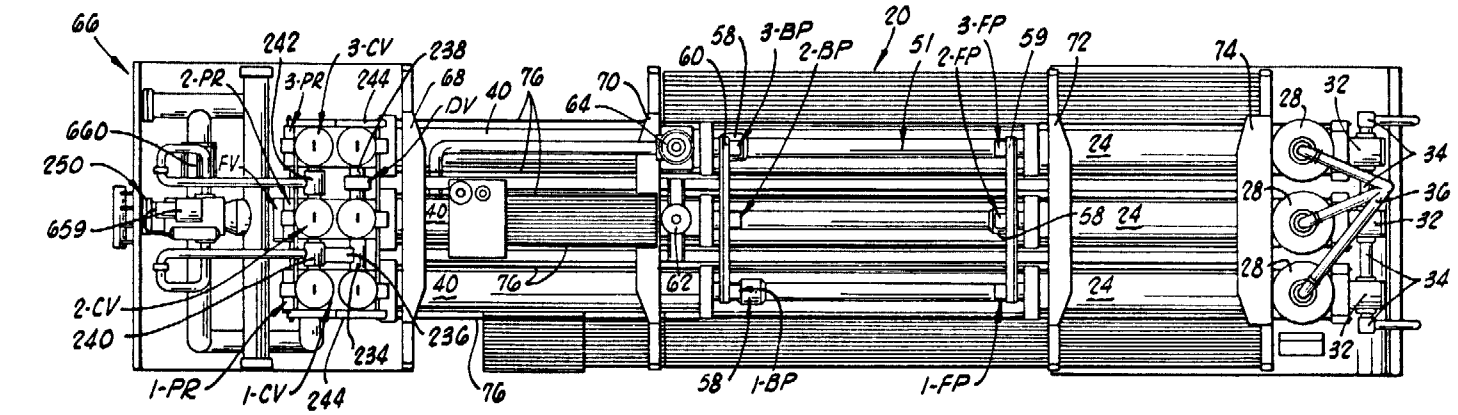
FIG. 2 is a top plan view of the pump illustrated in FIG. 1.

Referring now to FIGS. 1 and 2, the triplex pump of the present invention is generally designated by the reference character 20.

The pump 20 includes a fluid end assembly 22 comprising three substantially identical cylinders 24. The internal passages 26 of each of the fluid end cylinders 24 are each in communication with a valved pump cylinder head 28, each of which is provided with a suction check valve assembly 30 and a discharge check valve assembly 32. The discharge check valve assemblies 32 communicate with a common discharge manifold 34, providing one-way fluid flow therethrough from the cylinder heads 28 into the manifold 34 and the suction valve assemblies 30 communicate with a common suction header 36 providing one-way fluid flow therethrough from the suction header 36 into the cylinder heads 28. Each of the discharge check valve assemblies referred to is continously available to yieldably resist fluid flow into the discharge manifold 34. The yieldable resistance is operable during the precompression stage of a pumping cycle as well as during the discharge stage as will be described in detail hereinafter.

Extending from the fluid end assembly 22, in a direction away from the pump cylinder heads 28, is a power end assembly 38. The power end assembly includes three substantially identical power cylinders 40 each having an internal passage 41. Each of these power cylinders 40 is in generally longitudinal alignment with one of the fluid end cylinders 24. A piston rod assembly 42 extends longitudinally into each power end cylinder 40 and the respective aligned fluid end cylinder 24. The ends of the piston rod assemblies 42 which extend into the internal passage 26 of the fluid end cylinders 24 are provided with capped plunger ends which function as pumping pistons 44. The pumping pistons 44 are operable to bring about suction and discharge action in a conventional manner, and precompression action in a manner to be more fully described hereinafter.

The opposite ends, or power pistons, 46 of the piston rod assemblies 42 are in sliding and sealed engagement with the walls of the internal passages 41 of the power cylinders 40. In a manner to be more fully described, power fluid acts on opposite faces 48 and 50 of the power pistons 46 to reciprocate the piston rod assemblies 42.

The power end assembly 38 and the fluid end assembly 22 are separated by a spacer frame assembly 51 which permits the fluid end piston rods, or plungers, 52 and the power end piston rods 54 to be separate members thereby facilitating maintenance operations. The rods 52 and 54 are each hollow, cylindrical members sealingly received in the fluid end internal passages 26 and the power end internal passages 41, respectively, as indicated at 55 and 56. If desired, a floating annular rod seal may be employed so as to allow the rods to operate slightly eccentric to the power cylinder bores, thereby eliminating the necessity of extremely accurate alignment between the power cylinders and the fluid end cylinders.

Extending longitudinally of and internally of the members 52 and 54 are tie-rods 57 which are joined at the outer ends thereof to the pistons 44 and 46 and at the inner ends thereof with a cam actuator 58 to form, together with the rods 52 and 54 and their associated pistons 44 and 46, the integral piston rod assembly 42. The permissible stroke length of each piston rod assembly 42 is such that each cam actuator 58 is movable between a back position adjacent to a respective power end cylinder 40 and a forward position adjacent to the respective fluid end cylinder 24.

In a manner hereinafter more fully described, each cam actuator 58 is operable, in connection with a respective cycling valve FP, to provide a signal that a particular piston rod assembly 42 has reached its forward position. These cycling valves FP are mounted on the pump 20 at that forward position on a transverse valve mounting bar, indicated at 59. The location of this mounting bar 59 is such that the lengths of the valve engaging surfaces of the cam actuators 58 cooperate with the periodically remain in engagement with the valves FP in a tripped condition for a time sufficient to permit the necessary circuit functions to take place.

In a similar manner, each cam actuator 58 is operable, in connection with a precompression and stroke control valve or back position valve BP, to provide a signal that its associated piston rod assembly 42 has reached its back position. The precompression and stroke control valves BP are also mounted on the pump 20 at that back position on a transverse valve mounting bar, indicated at 60.

At the end of the power cylinders 40 remote from the fluid end assembly 22, each power cylinder 40 is in continuous communication with one of three identical control valve assemblies CV. To facilitate description of the pump of the present invention, the three control valves will be hereinafter referred to as 1-CV, 2-CV and 3-CV, respectively. Similarly, the hereinafter described identical portions of the C valve assemblies will be differentiated by the prefixes 1, 2 and 3, as will the associated power cylinder assemblies 40.

The function of the control valves CV is to direct power fluid to and from the power cylinders 40 in a manner such that the power cylinders each operate on a suction, precompression, discharge cycle, each power cylinder 40 being out of phase with the others.

In the discharge phase of the cycle in a given power cylinder 40, power fluid acts on the outer face 50 of the power piston 46 to a transmit force through the piston rod assembly 42 so as to cause the fluid end pumping piston 44 to move to its forwardmost stroke position whereby fluid in the cylinder head 28 is expelled through the discharge valve assembly 32 into the common discharge manifold 34. Prior to the discharge phase of the cycle, this fluid has been precompressed by power fluid acting on the power piston face 50 after passing through a precompression valve PR mounted on the control valve assembly CV. This precompression flow of power fluid causes the power piston 46, through the piston rod assembly 42, to move relatively slowly forward by an increment sufficient to compress the fluid to be pumped in the fluid end cylinder 24 and thereby raise the pressure of the fluid to approach the discharge pressure.

Suction movement of each power piston 46 is caused by power fluid acting on the inner face 48 of the power piston 46. The internal passages 41 of the power cylinders 40 are fluid interconnected in a normally closed circuit by a suitable common conduit 61. Thus, fluid in two rod ends of the passages 41, which fluid is displaced during precompression and discharge movement of the associated power pistons 46, is caused to flow through the common conduit 61 into the third passage 41 to act on the inner face 48 of the power piston 46 in that third passage 41.

In this manner, the suction, precompression and discharge functions are simultaneously and responsively performed, one function being performed in each fluid end cylinder 24. Therefore, constant pressure flow continually exists between the fluid end of the pump and the common suction header 36 and the common discharge manifold 34.

For purposes of accomplishing automatic stroke correction, as hereinafter more fully described, the common conduit 61 connecting rod ends of the power cylinders 40 is in fluid circuit with a conventional accumulator 62 and with a source of power fluid through a normally closed fill valve, FV. The conduit 61 and the rod ends of the power cylinders 40 are also in fluid circuit with a power fluid reservoir, remote from the pump 20, through a normally closed dump valve DV. Also a rod end relief valve 64 provides selective communication between the rod ends of the power cylinders 40 and the remote power fluid reservoir in the event the power fluid pressure at the rod ends of the power cylinders exceeds a predetermined pressure.

As will be further described, the control valve assemblies CV, the precompression valves PR, the fill valve FV and the dump valve DV which direct the power fluid, preferably water, are, in the illustrated embodiment, monitored by a separate control fluid circuit. The control fluid circuit preferably utilizes a different fluid such as oil, air or a combination thereof. It will, however, be apparent that controls other than a control fluid circuit (e.g., an electrical sensing arrangement) may be utilized to monitor the power circuit. In the illustrated embodiment it will be assumed that oil will be employed as the control fluid.

It will be appreciated that the elements of the control circuit, the control valve assemblies CV, the power end assembly 38, the fluid end assembly 22 and the spacer frame assembly 51, may all be mounted on a suitable common frame. In the illustrated embodiment, a tandem wheel semi-trailer 66 provides the common frame for supporting these elements. Preferably the mounting on the semi-trailer 66 is designed to permit the fluid end cylinders 24, the spacer frame assembly 51, and the power end cylinders 40 to move longitudinally relative to the semi-trailer for a limited distance, during reciprocation of the piston rod assemblies 42, so as to relieve any stresses on those members. Provision for such movement is made by slidably supporting the power end cylinders 40 within apertures formed in trailer crossmembers 68 and 70 and by slidably supporting the forward ends of the fluid end cylinders 24 within apertures formed in trailer crossmember 72 formed on the semi-trailer 66. The rearward ends of the fluid end cylinders 24 are rigidly secured to trailer crossmember 74 as are the cylinder heads 28. The fluid end cylinders 24, spacer frame assembly 51 and power end cylinders 40 are suitably joined by longitudinal tie bars 76. The transverse valve mounting bars 59 and 60 are each preferably secured to two of the uppermost longitudinal tie bars 76.

A suitable control fluid assembly 78 is mounted on the semi-trailer 66 below the power end assembly 38 and the spacer frame assembly 51. The control fluid assembly 78 includes a pump assembly 80, control fluid reservoir assembly 82, relief valve 84 and accumulators 86 and 88.

The Control Valve Assembly

Figure 4:
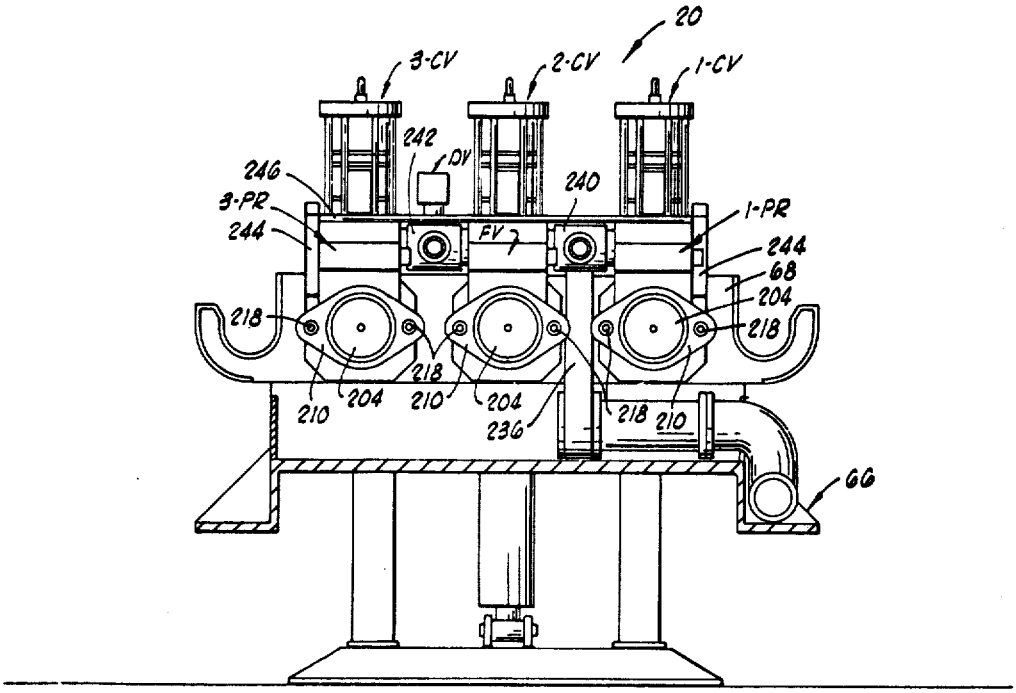
FIG. 4 is a front elevational view of the pump similar to FIG. 3 with portions removed to more clearly illustrate the control valve assemblies associated with the power end of the pump and the location of the precompression, fill and dump valves.
Figure 5:
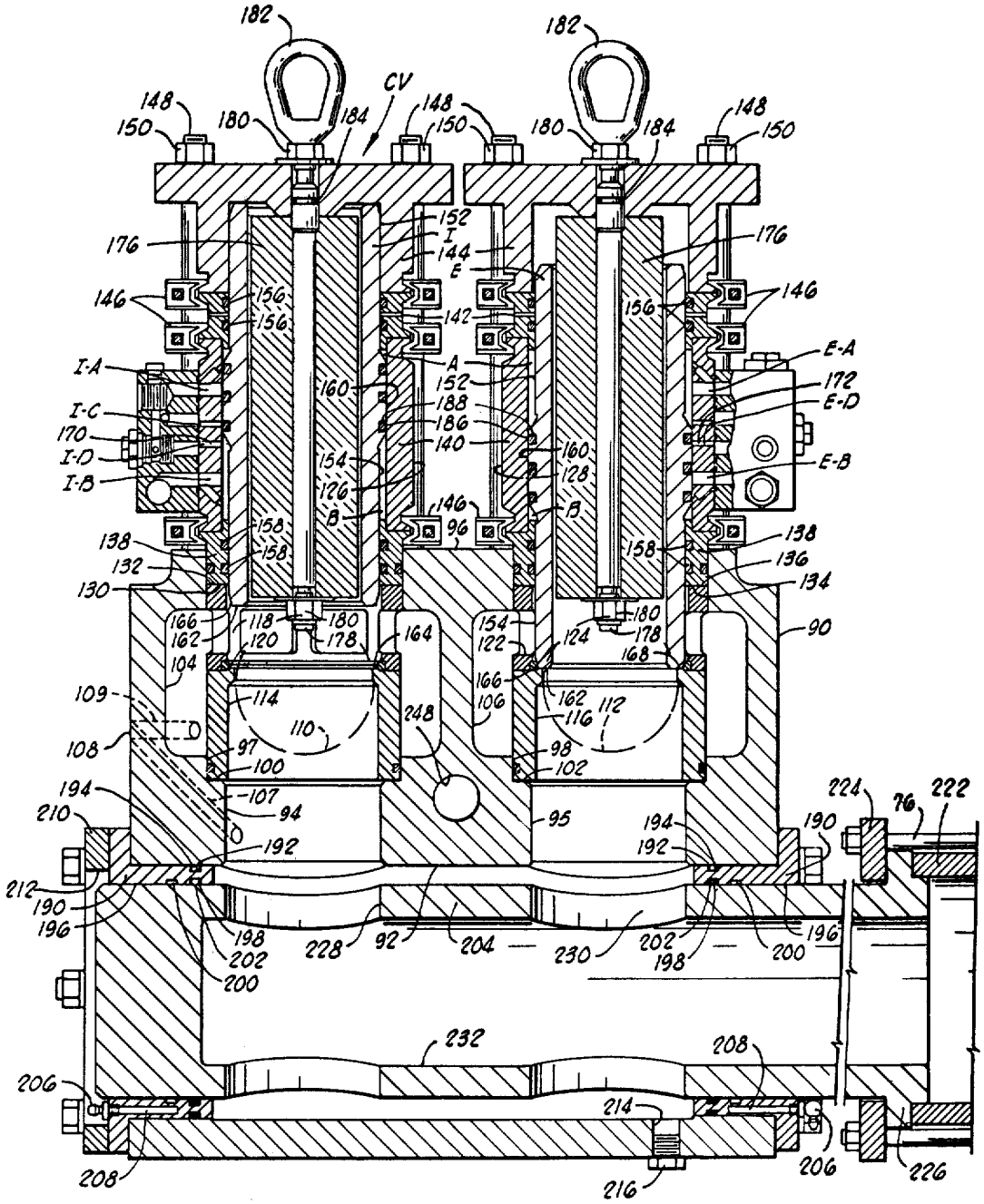
FIG. 5 is a cross-sectional view of one control valve assembly.

Referring now to FIGS. 4 and 5, the previously identified identical control valve assemblies 1-CV, 2-CV and 3-CV will be described.

From the cross-sectional view of one control valve assembly illustrated in FIG. 5, it will be seen that each control valve assembly includes a housing 90 having a longitudinal bore 92 extending therethrough. An inlet bore 94 and an exhaust bore 95 are formed in the housing 90 and communicate between the longitudinal bore 92 and the upper surface 96 of the housing 90. Counterbores 97 and 98 are formed respectively in the bores 94 and 95 forming respective annular shoulders 100 and 102 therein. Annular inlet and exhaust chambers 104 and 106 are formed respectively in the counterbores 97 and 98. A precompression passageway 107 is formed in the housing 90 and communicates between the inlet bore 94 and the front side 108 of the housing 90. A power fluid passageway 109 communicates between the inlet chamber 104 and the front side 108 of the housing 90. The annular inlet chamber 104 communicates with the opposite vertical sides of the housing 90 through a pair of lateral inlet ports 110 formed in the housing 90 and positioned on opposite sides of the chamber 104. Similarly, the annular exhaust chamber 106 communicates with the vertical sides of the housing 90 through a pair of lateral exhaust ports 112 formed in the housing 90 and positioned on opposite sides of the chamber 106.

A cylindrically shaped inlet seat mount 114 is positioned within the counterbore 97 abutting the annular shoulder 100. A substantially identical exhaust seat mount 116 is positioned within the counterbore 98 abutting the annular shoulder 102. A substantially cylindrically shaped slotted inlet spacer 118 is positioned within the counterbore 97 abutting the upper end face of the inlet seat mount 114. An annular inlet valve seat 120 is securely mounted between the inlet seat mount 114 and the slotted inlet spacer 118. A substantially cylindrical slotted exhaust spacer 122 is positioned within the counterbore 98 and abuts the upper surface of the exhaust seat mount 116. An annular exhaust valve seat 124 is secured between the slotted exhaust spacer 122 and the exhaust seat mount 116.

An inlet cylinder assembly 126 and a substantially identical exhaust cylinder assembly 128 are mounted with their respective lower end portions disposed in the respective counterbores 97 and 98 of the housing 90. The lower end face 130 of the inlet cylinder assembly 126 abuts the upper end face 132 of the slotted inlet spacer 118. The lower end face 134 of the exhaust cylinder assembly 128 abuts the upper end face 136 of the slotted exhaust spacer 122.

Each of the identical inlet and exhaust cylinder assemblies 126 and 128 includes a lower bearing and seal member 138 extending into the respective counterbores 97 and 98, a cylinder 140 extending upwardly from the lower bearing and seal member 138, an upper bearing and seal member 142 extending upwardly from the cylinder 140 and a cover 144 extending upwardly from the upper bearing and seal member 142 and capping the respective inlet and exhaust cylinder assemblies 126 and 128. The elements of the inlet and exhaust assemblies 126 and 128 are secured together by means of suitable annular V-retainer couplings 146.

The inlet cylinder assembly 126 and the exhaust cylinder assembly 128 are each rigidly secured to the housing 90 by means of a plurality of threaded studs 148 extending through apertures in the cover 144 and received in threaded holes in the housing 90 and by threaded nuts 150 secured to the upper ends of the studs 148. A cylindrically shaped inlet sleeve valve member I is slidably disposed within the inlet cylinder assembly 126. An identical cylindrically shaped exhaust sleeve valve member E is slidably disposed within the exhaust cylinder assembly 128. The upper and lower outer cylindrical surfaces 152 and 154 of the valve members I and E are sealingly engaged by the annular seals 156 and 158 carried respectively by the upper and lower bearing and seal members 142 and 138 of the inlet and exhaust cylinder assemblies 126 and 128. Approximately midway of each of the valve members I and E there is provided an external cylindrically shaped flange 160 which engages the internal wall in the respective cylinder 140 of the inlet and exhaust cylinder assemblies 126 and 128. These flanges 160 function as pistons and define, together with an upper and lower cylindrical surfaces 152 and 154 of the valve members I and E and the upper and lower bearing and seal members 142 and 138 and their annular seals 156 and 158 located at opposite ends of each of the cylinders 140, upper and lower control fluid chambers A and B.

It will be appreciated that the internal diameters of the upper and lower bearing and seal members 142 and 138 are substantially equal to the diameters of the upper and lower outer cylindrical surfaces 152 and 154 of the valve members I and E. It will be further appreciated that the length of each of the valve members I and E is greater than the distance between the annular seals 156 and 158 of the upper and lower boaring and seal members 142 and 138. Thus, regardless of the position of the valve members I and E, the control fluid chambers A and B are continually isolated from power fluid passing through the controlled by the control valve CV.

When the valve member I is in its down or lower position, the lower end face 162 thereof is positioned proximate to an annular shoulder 164 of the inlet seat mount 114, preferably just short of abutment therewith. The outer periphery 166 of the valve member I adjacent to the end face 162 sealingly engages the annular inlet valve seat 120 thereby blocking communication between the annular inlet chamber 104 and the longitudinal bore 92 of the housing 90.

Similarly, when the exhaust valve member E is in its down or lower position the lower end face 162 thereof is positioned proximate to an annular shoulder 168 of the exhaust seat mount 116, preferably just short of abutment therewith. The outer periphery 166 of the valve member E adjacent to the lower end face 162 sealingly engages the annular exhaust valve seat 124, thereby blocking communication between the annular exhaust chamber 106 and the longitudinal bore 92 of the housing 90.

It will be seen that when communication between the annular inlet chamber 104 and the longitudinal bore 92 of the housing 90 is blocked by the inlet valve member I, communication between the power fluid source and the power cylinder 40 is blocked. Similarly, when communication between the annular exhaust chamber 106 and the longitudinal bore 92 of the housing 90 is blocked by the exhaust valve member E, communicated between the power cylinder 40 and the power fluid reservoir is blocked. When the inlet valve member I is in the upper or open position, communication is open between the longitudinal bore 92 of the housing 90 and the source of power fluid. Similarly, when the exhaust valve member E is in the upper or open position, communication is open between the longitudinal bore 92 of the housing 90 and the power fluid reservoir.

Movement of the valve members I and E to the upper open position and the lower closed position to control power fluid flow through the control valve CV, is accomplished through the use of a pressurized control fluid. The control fluid causes such valve member movement by entering the cylinders 140 of the inlet and exhaust cylinder assemblies 126 and 128 through control ports extending laterally therethrough. These control ports are labeled I-B, E-B, I-A and E-A respectively, and are defined by (unnumbered) communicating passages of different diameters.

Pressurization of the upper control ports I-A and E-A causes control fluid to enter the upper control chambers A of the inlet cylinder assembly 126 and the exhaust cylinder assembly 128. The valve members I and E are thus caused to move to their lower or closed positions, as illustrated by the valve member E in FIG. 5. Conversely, pressurization of the lower control ports I-B and E-B moves the valve members I and E to their upper or open positions, as indicated by the valve member 1 in FIG. 5, by actuation of control fluid in the lower chamber B upon the pistons 160.

The valve members I and E are hydraulically cushioned or decelerated near the end of either an upward or a downward stroke by the restriction offered by the smaller of the two passages comprising the control ports A and B. When a given valve member nears completion of a shaft in either direction, the larger passages are covered by the piston 160 causing the fluid exhausting from the actuator chamber to pass through the smaller passage.

It will be seen that the cylinders 140 of the inlet and exhaust cylinder assemblies 126 and 128 are provided with further control ports labeled I-D and E-D. The function of these ports is to supply makeup control fluid to the upper control ports I-A and E-A as will be described subsequently. At this point, it need only be noted that the positioning of the D ports between the A and B ports is such that D ports are blocked by the pistons 160 of the valve members I and E in all positions of the valve members except the uppermost positions thereof, as indicated respectively at 170 and 172.

In connection with the inlet valve members I and their associated cylinders 140, it will be seen that a further control port I-C is provided between I-A and I-D ports. In a manner to be described hereinafter, this port I-C functions to supply a signal that the valve member I of the associated control valve assembly CV is in its closed position. When the valve member I is in the lower or closed position, the I-C port communicates with the upper control fluid chamber A. In all other positions of the valve member I, the I-C port is blocked by the piston 160.

The inlet cylinder assembly 126 and the exhaust cylinder assembly 128 each include a cylindrically shaped plug 176 disposed within the respective valve members I and E. Each plug 176 is secured to the cover 144 by means of a bolt 178 extending through the plug 176 and the cover 144. A threaded nut 180 is threadedly engaged on each end of the bolts 178 to firmly secure the plug 176 to the cover 144. A threaded eye 182 is threadedly secured to the upper end of each bolt 178 above the adjacent nut 180. A suitable annular seal 184 is carried by the bolt 178 to provide a fluid tight seal between the bolt 178 and the cover 144.

Each flange 160 of the valve members I and E includes three annular piston rings 186 disposed in circumferential grooves 188 formed in the cylindrically shaped periphery of the flange 160. The piston rings 186 provide a fluid tight sliding seal between the flange 160 and the respective cylindrically shaped inner periphery of the cylinder 140.

A housing bearing 190 is disposed in each end of the longitudinal bore 92 through the housing 90. Each housing bearing 190 carries an annular seal 192 in a circumferential groove 194 which provides a fluid tight seal between the housing bearing 190 and the longitudinal bore 92. Each housing bearing 190 has a cylindrically shaped inner periphery 196 in which annular grooves 198 and 200 are formed. An annular T-piston seal 202 is disposed in each groove 198 and provides a fluid tight seal between the control valve CV and a power fluid entry and exhaust chamber 204 communicating with the corresponding power cylinder 40. A grease fitting 206 is threadedly secured in each housing bearing 190 and communicates with the annular groove 200 via a passageway 208 formed in the housing bearing 190.

A retainer flange 210 having an aperture 212 formed therein is positioned adjacent to the housing bearing 190 positioned adjacent to the inlet cylinder assembly 126 of the control valve CV. The retaining flange 210 and the adjacent housing bearing 190 are secured to the housing 90 by means of six threaded cap screws extending through the retainer flange 210 and the housing bearing 190 and threadedly engaged with the housing 90. The housing bearing 190 at the opposite end of the housing 90 is fixedly secured to the housing 90 by means of six cap screws extending through the housing bearing 190 and threadedly engaged in threaded holes formed in the housing 90.

A drain hole 214 is formed in the bottom of the housing 90 and communicates between the exterior thereof and the longitudinal bore 92 therethrough. A threaded plug 216 is threadedly engaged in the drain hole 214 to provide a fluid tight sealing closure of the drain hole 214.

Each of the control valves, 1-CV, 2-CV and 3-CV is rigidly secured to the trailer crossmember 68 by means of a pair of threaded bolts 218 extending through the respective retainer flange 210 and threadedly received in the trailer crossmember 68. Each of the bolts 218 extends longitudinally through a positioning tube 220 which bears at its opposite ends against the retainer flange 210 and the trailer crossmember 68. This arrangement provides positive longitudinal positioning of the control valves 1-CV, 2-CV and 3-CV relative to the trailer 66 and the trailer crossmember 68.

The cylindrically shaped power fluid entry and exhaust chamber 204 is secured on the forward end portion 222 of each power cylinder 40 by means of a retaining collar 224 encircling a flange 226 formed on one end of the chamber 204 and secured by four tie bars 76. Each chamber 204 is slidably received in a respective control valve housing 90 and is sealingly engaged about its outer periphery by the seals 202 in the housing bearings 190. Lateral passages 228 and 230 extend through each chamber 204 and provide communication between the inner chamber 232 thereof and the inlet and exhaust bores 94 and 95 of the respective control valve CV.

The sliding relationship of the chambers 204 to the housings 90 of the control valves 1-CV, 2-CV and 3-CV permits the chambers 204 to move longitudinally within the respective housings 90 in response to extension and contraction of the fluid end assembly 22, power end assembly 38, and spacer frame assembly 51 of the pump 20 during its operation. It will be seen that the inner chamber 232 of each chamber 204 communicates with the internal passage 41 of a respective power cylinder 40.

When the control valve assemblies 1-CV, 2-CV and 3-CV are assembled on the pump 20, the adjacent lateral exhaust ports 112 of the 1-CV and 2-CV control valve assemblies are interconnected by exhaust manifold 234 which includes a downwardly extending power fluid return conduit 236. The adjacent lateral exhaust ports 112 of the 2-CV and 3-CV control valve assemblies are interconnected by exhaust manifold 238. Similarly, the adjacent lateral inlet ports 110 of the 1-CV and 2-CV control valve assemblies are interconnected by inlet manifold 240 while the adjacent lateral inlet ports 110 of the 2-CV and 3-CV control valve assemblies are interconnected by inlet manifold 242.

The inlet manifolds 240 and 242 are connected by conduits to two of the lateral outlet ports of the shut off valve assembly which will be described in detail below. These conduits supply pressurized power fluid to the control valve assemblies via the inlet manifolds 240 and 242 and the lateral inlet ports 110 of the control valve assemblies 1-CV, 2-CV and 3-CV.

The control valve assemblies 1-CV, 2-CV and 3-CV are secured together along with the manifolds 234, 238, 240 and 242 by means of two V-shaped brackets 244 interconnected by three threaded tie rods 246. The brackets provide sealing closure of the outer inlet and outlet ports 110 and 112 of the control valve assemblies 1-CV and 3-CV. The lower of the three tie rods 246 extends through suitable apertures 248 formed in the housings 90 of the control valve assemblies 1-CV, 2-CV and 3-CV.

The Shut Off Valve Assembly

Figure 3:
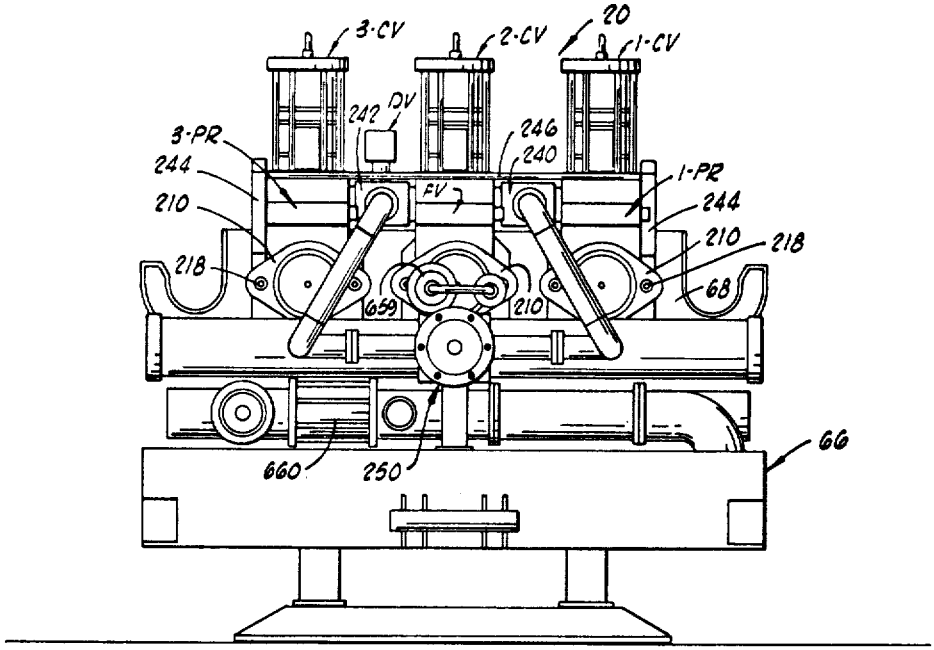
FIG. 3 is a front elevational view of the pump illustrated in FIG. 1.
Figure 9:
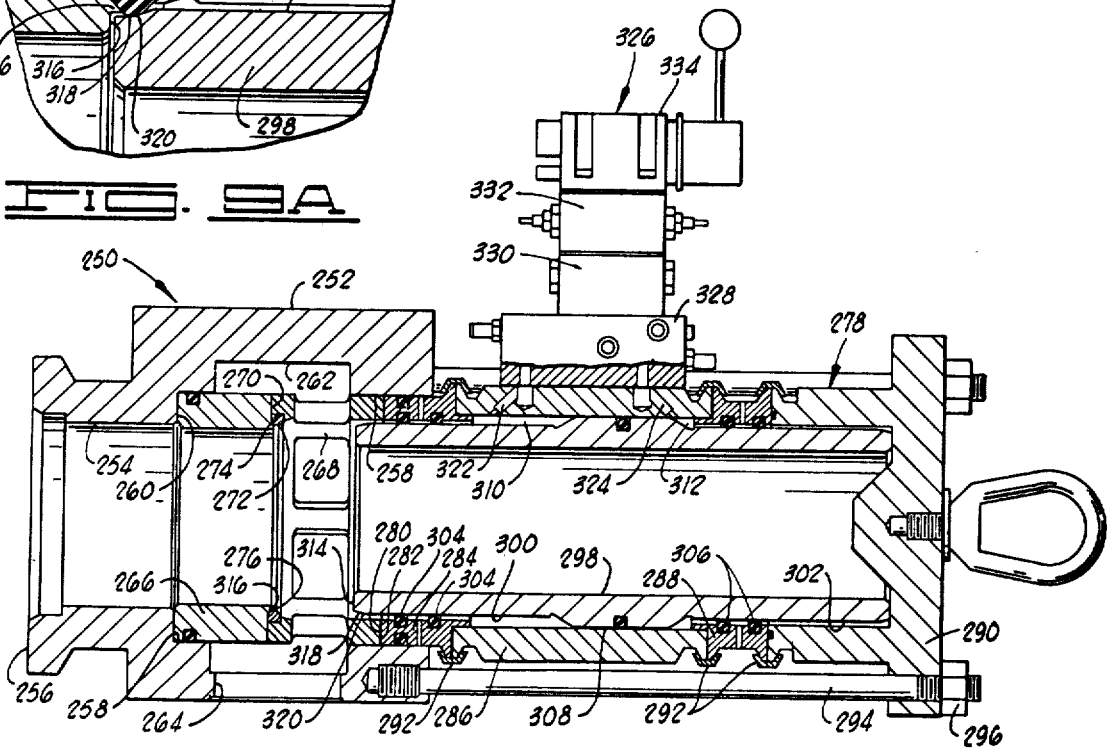
FIG. 9 is a cross-sectional view of the shut off valve.

Referring now to FIGS. 3 and 9, the construction of the shut off valve assembly 250 will be described in detail.

From the cross-sectional view of the shut off valve assembly illustrated in FIG. 9, it will be seen that the shut off valve assembly includes a housing 252 having a longitudinal bore 254 extending therethrough. The bore 254 communicates with the inlet end 256 of the housing 252. A counterbore 258 is formed in the bore 254 and forms an annular shoulder 260 interconnecting the counterbore 258 and the bore 254. An annular chamber 262 is formed in the counterbore 258 and communicates with the exterior of the housing 252 through three lateral outlet ports 264 formed in the housing 252 with two of the ports 264 positioned on opposite sides of the annular chamber 262, and the third port 264 positioned angularly intermediate the other two ports. The axes of the three ports 264 are substantially coplanar.

A cylindrically shaped seat mount 266 is positioned within the counterbore 258 abutting the annular shoulder 260. A substantially cylindrically shaped slotted spacer 268 is positioned within the counterbore 258 abutting the end face 270 of the seat mount 266. An annular valve seat 272 is securely mounted between the seat mount 266 and the slotted spacer 268. The valve seat 272 may be suitably formed of a resilient synthetic material such as nylon. The annular valve seat 272 is received in an annular groove 274 formed in the slotted spacer 268 and is securely retained therein by an annular rib 276 extending outwardly from the end face 270 of the seat mount 266. It will be seen from the drawing that the configuration of the annular groove 274 and the annular rib 276 prevent any possibility of the valve seat 272 becoming dislodged therefrom.

The shut off valve assembly 250 includes a cylinder assembly 278 mounted with one end portion thereof disposed in the counterbore 258. One end face 280 abuts the upper end face 282 of the slotted spacer 268.

The cylinder assembly 278 includes a first bearing and seal member 284 extending into the counterbore 258, a cylinder 286 extending longitudinally from the first bearing seal member 284, a second bearing and seal member 288 extending longitudinally from the cylinder 286 and a cover 290 extending longitudinally from the second bearing and seal member 288 and capping the cylinder assembly 278. The elements of the cylinder assembly 278 are secured together by means of suitable annular V-retainer couplings 292.

The cylinder assembly 278 is rigidly secured to the housing by means of a plurality of threaded studs 294 threadedly engaged with the housing 252 and extending through respective apertures formed in the cover 290, and threaded nuts 296 secured to the threaded studs 294.

A cylindrically shaped sleeve valve member 298 is slidably disposed within the cylinder assembly 278. The first and second outer cylindrical surfaces 300 and 302 of the sleeve valve member 298 are sealingly engaged by annular seals 304 and 306 carried respectively by the first and second bearing and seal members 284 and 288. Approximately midway of the sleeve valve member 298, there is provided an external cylindrically shaped flange 308 which engages the internal wall of the cylinder 286 of the cylinder assembly 278. The flange 308 functions as a piston and defines, together with the first and second cylindrical surfaces 300 and 302 of the sleeve valve member 298 and the first and second bearing and seal members 284 and 288 and their annular seals 304 and 306 located in the opposite ends of the cylinder 286, opening and closing fluid chambers 310 and 312.

It will be appreciated that the internal diameters of the first and second bearing and seal members 284 and 288 are substantially equal to the diameters of the first and second outer cylindrical surfaces 300 and 302 of the sleeve valve member 298. It will be further appreciated that the length of the sleeve valve member 298 is greater than the distance between the annular seals 304 and 306 of the first and second bearing and seal members 284 and 288. Thus, regardless of the position of the sleeve valve member 298, the opening and closing control fluid channel members 310 and 312 are continually isolated from power fluid passing through and controlled by the shut off valve assembly 250.

When the sleeve valve member 298 is in its closed position, the lower end face 314 thereof is positioned proximate to an annular shoulder 316 formed on the seat mount 266 and extending radially inwardly from the annular rib 276, preferably just short of abutment with the annular shoulder 316. The outer periphery 318 of the sleeve valve member 298 adjacent to the end face 314 sealingly engages the annular valve seat 272 thereby blocking communication between the longitudinal bore 254 and the lateral outlet ports 264 of the housing 252.

As shown in FIG. 9, the clearance between the outer periphery 318 of the sleeve valve member 298 and the annular rib 276 formed on the seat mount 266, where the sleeve valve member 298 is in the closed position, is of such dimension that extrusion of the annular valve seat 272 between the sleeve valve member 298 and the seat mount 266 is prevented when pressure exists above the valve seat 272 or outside the sleeve valve member 298, and the pressure below the valve seat 272 or inside the sleeve valve member 298 is substantially lower or zero. The annular sealing contact between the sleeve valve member 298 and the annular valve seat 272 is initially located at the tapered surface 320 interconnecting the outer cylindrical surface 300 and the outer cylindrical periphery 318 of the sleeve valve member 298. In service the annular valve seat 272 typically experiences plastic flow, causing it to fully mate and sealingly engage the tapered surface 320 and the cylindrical outer periphery 318.

Movement of the sleeve valve member 298 to the open position and to the closed position to alternately open and close the shut off valve assembly 250 to power fluid flow therethrough is accomplished through the use of a pressurized control fluid. The control fluid causes the sleeve valve member 298 to move by entering the cylinder 286 of the cylinder assembly 278 through first and second control ports 322 and 324.

Pressurization of the first control port 322 causes pressurized control fluid to enter the opening fluid chamber 310 of the cylinder assembly 278. The sleeve valve member 298 is thus caused to move from its closed position to its open position, as illustrated in FIG. 9. Conversely, pressurization of the second control port 324 causes control fluid to enter the closing fluid chamber 312 thus causing the sleeve valve member 298 to move to the enclosed position in response to the force of the pressurized control fluid in the closing fluid chamber 312 acting on the flange or piston 308.

Control fluid is directed to either the opening fluid chamber 310 or the closing fluid chamber 312 by means of a shut off valve actuator assembly 326. The shut off valve actuator assembly 326 includes a cylinder manifold 328 bolted to the cylinder 286 and provides suitable connection to a source of pressurized control fluid and to a control fluid reservoir. The shut off valve actuator assembly 326 further includes a double pilot operated check valve 330 of the conventional construction and secured to the manifold 328. The double pilot operated check valve 330 provides suitable means for locking the sleeve valve member 298 in either the open or closed position after actuation thereof.

The shut off valve actuator assembly 326 further includes an adjustable flow control valve 332 secured to the double pilot operated check valve 330 and providing fluid communication therewith. The adjustable flow control valve 332 is of conventional construction and provides means for controlling the velocity of the sleeve valve member 298 as it moves alternately between open and closed positions.

Finally, the shut off valve actuator assembly 326 includes a manually operated four way hydraulic control valve 334 secured to the adjustable flow control valve 332 to provide manually actuated means for applying the pressurized control fluid received in the manifold 328 to either the opening or closing fluid chamber 310 or 312 while simultaneously connecting the other fluid chamber 312 or 310 to the control fluid reservoir.

The manually operated four way hydraulic control valve 334 employed is the shut off valve actuator assembly 326 is preferably a conventional unit available from Racine Hydraulics and Machinery, Inc., Sarasota, Fla. The adjustable flow control valve 332 is also a conventional unit available from Racine Hydraulics and Machinery, Inc. as is the double pilot operated check valve 330.

Precompression Valve

As shown in FIG. 6, each of the three precompression valves PR comprises a rectangularly shaped valve body 350. The valve body 350 includes a longitudinal passageway 352 extending therethrough and communicating with the first end portion 354 and the second end portion 356 of the valve body 350. One side 358 of the valve body 350 is provided with a machined surface and is adapted to be secured directly to the front side 108 of the housing 90 of a respective control valve CV. The valve body 350 is typically secured to the housing 90 by means of a plurality of threaded screws 360 extending through the valve body 350 and threadedly engaged in threaded holes formed in the housing 90.

The passageway 352 includes a first counterbore 362 formed therein from the first end portion 354. The first counterbore 362 forms an annular shoulder 364 which extends radially inwardly from an annular relief groove 366 preferably formed in the first counterbore 362 adjacent to the annular shoulder 364. The diameter of the first counterbore 362 is preferably approximately 1⅞ inches.

A second counterbore 368 is formed in the passageway 352 from the first end portion 354 with the cylindrical surface thereof communicating with the cylindrical surface of the first counterbore 362 by means of an interconnecting tapered annular surface 370. The diameter of the second counterbore 368 is preferably approximately 2 inches. The passageway 352 includes an internally threaded portion 372 extending from the cylindrical surface of the second counterbore 368 to the first end portion 354.

A third counterbore 374 is formed in the passageway 352 from the second end portion 356 of the valve body 350. An annular shoulder 376 extends radially inwardly from an annular relief groove 378 preferably formed in the cylindrical surface of the third counterbore 374 adjacent to the annular shoulder 376. The diameter of the cylindrical surface of the third counterbore 374 is preferably approximately 2¼ inches.

The passageway 352 further includes an internally threaded portion 380 extending from the second end portion 356 of the valve body 350 to an annular relief groove 382 which is in turn connected to the cylindrical surface of the third counterbore 374 by an annular shoulder 384.

A sleeve 386 is positioned within the first counterbore 362 and a portion of the second counterbore 368 with one end face 388 thereof abutting the annular shoulder 364. A fluid tight seal is formed between the sleeve 386 and the cylindrical surface of the first counterbore 362 by a T-piston seal 390 disposed in an annular groove formed in the cylindrical periphery of the sleeve 386.

A cylindrically shaped carbide valve member 392 is longitudinally slidably disposed in a longitudinal bore 394 extending through the sleeve 386 along the longitudinal axis thereof. A fluid tight seal is provided between the valve member 392 and the longitudinal bore 394 by means of a T-rod seal 396 carried in an annular groove formed in the cylindrical surface of the bore 394.

A cylindrically shaped carbide valve seat 398 is positioned within the second counterbore 368 with the inner end face 400 thereof abutting the outer end face 402 of the sleeve 386. The valve seat 398 includes a longitudinal bore 403 extending therethrough with a frusto-conical seating surface 404 formed thereon and interconnecting the bore 403 and the inner end face 400 of the valve seat 398. The seating surface 404 is sized and shaped to sealingly engage a mating frusto-conical seating surface 406 formed on the valve member 392 to provide a fluid tight seal between the valve member 392 and the valve seat 398 upon the engagement of the seating surfaces 404 and 406. A fluid tight seal is formed between the valve seat 398 and the cylindrical surface of the second counterbore 368 by a T-rod seal 407 disposed in an annular groove formed in the cylindrical surface of the counterbore 368.

An externally threaded seat retainer 408 is threadedly engaged with the internally threaded portion 372 of the valve body 350 with the inner end face 410 thereof abutting the outer end face 412 of the valve seat 398. This positioning of the seat retainer 408 within the valve body 350 secures the valve seat 398 and the sleeve 386 within the passageway 352. A fluid tight seal is achieved between the seat retainer 408 and the cylindrical surface of the second counterbore 368 by means of a T-piston seal 414 carried in an annular groove formed in the first cylindrical outer periphery 416 of the seat retainer 408. A second cylindrical outer periphery 418, of a lesser diameter than the first cylindrical outer periphery extends from the first cylindrical outer periphery 416 to the inner end face 410 of the retainer seat 408. An annular shoulder 420 interconnects the first and second cylindrical outer peripheries 416 and 418 of the seat retainer 408. A counterbore 422 is formed along the longitudinal axis of the seat retainer 408 and communicates with the inner end face 410 thereof. A plurality of ports 424 provide fluid communication between the cylindrical surface of the counterbore 422 and the second cylindrical outer periphery 418 of the seat retainer 408.

A pressure input port 426 communicates between the side 358 of the valve body 350 and the interior of the counterbore 422 via the ports 424. An additional port 428 is formed in the valve body 350 and communicates between the opposite side 430 thereof and the interior of the counterbore 422 via the ports 424. The port 428 includes internal threads 432 in which a plug or hydraulic hose fitting may be threadedly secured. An O-ring 434 is disposed in an annular groove 436 formed in the side 358 of the valve body 350 concentric with the pressure input port 426 to provide a fluid tight seal between the side 358 of the valve body 350 and the front side 108 of the housing 90 of the respective control valve CV on which the precompression valve PR is mounted, and further provide sealed fluid communication between the pressure input port 426 and the power fluid passageway 109 in the housing 90.

A pressure output port 438 is formed in the valve body 350 and communicates between the side 358 thereof and the second counterbore 368. A counterbore 440 is formed in the sleeve 386 and communicates with the outer end face 402 thereof. A lateral port 442 is formed in the sleeve 386 and communicates between the counterbore 440 and the outer periphery of the sleeve 386 adjacent to the port 438. An orifice 444 is positioned within the pressure output port 438 providing restricted fluid communication between the side 358 of the valve body 350 and the counterbore 440 of the sleeve 386. An O-ring 446 is disposed in an annular groove 448 formed in the side 358 of the valve body 350 concentric with the port 438 and orifice 444 to provide a fluid tight seal between the side 358 of the valve body 350 and the housing 90 of the respective control valve CV and provide sealed fluid communication between the pressure output port 438 and the precompression passageway 107 in the housing 90.

A piston 450 is slidably disposed within the third counterbore 374 with its inner end face 452 abutting the adjacent end face 454 of the valve member 392. A fluid tight seal is provided between the piston 450 and the cylindrical surface of the third counterbore 374 by means of a T-rod seal 456 carried in an annular groove formed in the cylindrical surface of the third counterbore 374.

An externally threaded bushing 458 is threadedly secured within the internally threaded portion 380 of the valve body 350 with a fluid tight seal achieved therebetween by an O-ring 460. A longitudinal passageway 462 having an internally threaded portion 464 formed therein extends through the bushing 458 to provide communication between the face 466 of the piston 450 and a source of fluid pilot pressure suitably threadedly connected to the internally threaded portion 464.

In operation, when the power fluid is applied to the pressure input port 426 at a pressure of approximately 5000 psi, power fluid flow through the precompression valve PR is prevented by the sealing engagement between the seating surfaces 404 and 406 of the valve seat 398 and the valve member 392 as long as a sufficient pilot pressure is applied through the passageway 462 to the relatively large diameter face 466 of the piston 450. At such time as the pilot pressure is reduced below a predetermined level, the reduced pilot pressure allows the piston 450 to move toward the bushing 458 under the urging of the pressurized power fluid thereby releasing closing pressure on the valve member 392 and allowing the power fluid to flow through the pressure input port 426 and out through the orifice 444 via the ports 424, counterbore 422, bore 403, counterbore 440 and lateral port 442.

The Fill Valve

Figure 7:
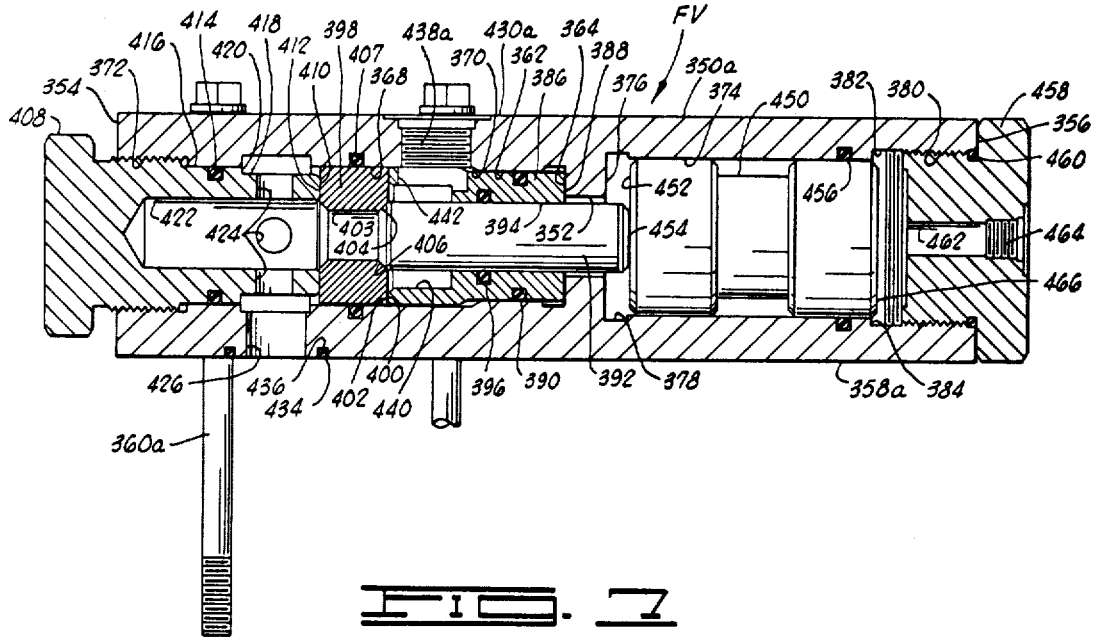
FIG. 7 is a cross-sectional view of the fill valve.

The fill valve FV is substantially identical in construction to the precompression valve PR and differs only in employing a slightly modified rectangularly shaped valve body **350*a*, as illustrated in FIG. 7. The valve body 350*a* differs from the valve body 350 of the precompression valve PR only in the detail construction of ports formed therein communicating with a longitudinal passageway 352** extending therethrough. Those elements identical to the elements employed in the precompression valve PR will be designated by the same reference characters to simplify the description of the structure of the fill valve FV.

The valve body **350*a* of the fill valve FV includes a pressure input port 426 which communicates between one side 358*a* of the valve body 350*a* and the counterbore 422 of the seat retainer 408 via the ports 424. An O-ring 434 is positioned in an annular groove 436 formed in the side 358*a* of the valve body 350 concentric with the pressure input port 426** to provide a fluid tight seal for purposes which will be explained in detail hereinafter.

An internally threaded output port **438*a* communicates between the opposite side 430*a* of the housing 350*a* and the counterbore 440 of the sleeve 386 via the lateral port 442 formed in the sleeve 386**.

The remainder of the structure of the fill valve FV is identical to that previously described for the precompression valve PR and functions in substantially the same way.

In operation, when the pressurized power fluid is applied to the pressure input port 426 at a pressure of approximately 5000 psi, the power fluid flow through the fill valve FV is prevented by the sealing engagement between the seating surfaces 404 and 406 of the valve seat 398 and the valve member 392 as long as a sufficient pilot pressure is applied through the passageway 462 to the face 466 of the piston 450. At such time as the pilot pressure is reduced below a predetermined level, the piston 450 will move toward the bushing 458 in response to the urging of the pressurized power fluid thereby releasing pressure on the valve member 392 and allowing the power fluid to flow through the pressure input port 426 and out through the output port **438*a* via the ports 424, counterbore 422, bore 403, counterbore 440 and lateral port 442**.

The fill valve FV is preferably assembled along with a precompression valve PR to the front side 108 of the housing 90 of the control valve 2-CV. When assembled in this manner, the fill valve FV is positioned with its one side **358*a* engaging the side 430 of the adjacent precompression valve PR. The O-ring 434 engages the side 430 of the valve body 350 of the precompression valve PR and provides fluid tight communication between the port 428 of the precompression valve PR and the pressure input port 426 of the fill valve FV. The fill valve FV and the precompression valve PR associated therewith are secured to the housing 90 of the control valve 2-CV by means of a plurality of threaded screws 360*a* of sufficient length to pass through the valve body 350*a* of the fill valve FV and the valve body 350 of the precompression valve PR to be threadedly received in the housing 90 of the control valve 2**-CV.

The Dump Valve

Figure 8:
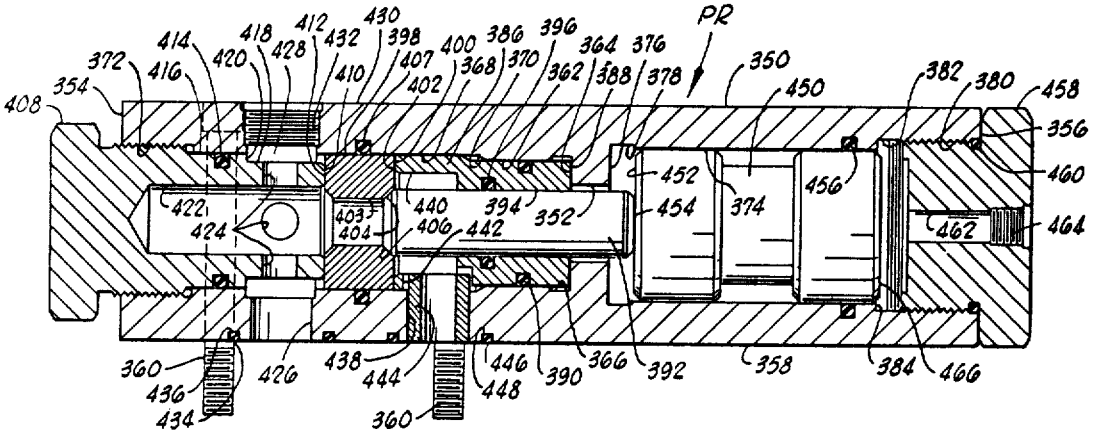
FIG. 8 is a cross-sectional view of the dump valve.
Figure 8:
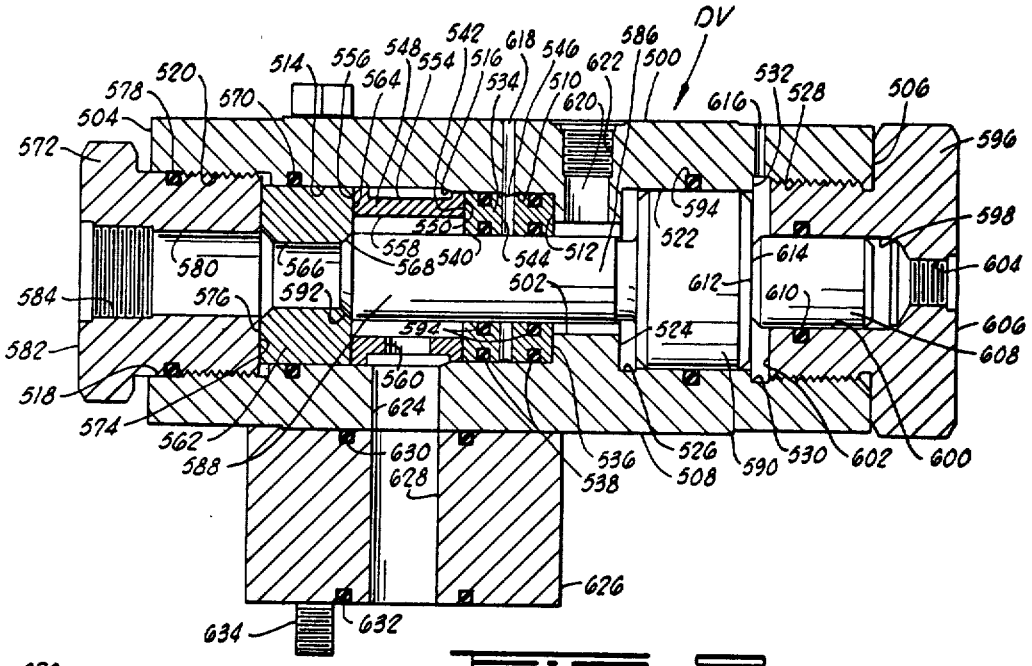
Figure 8A:
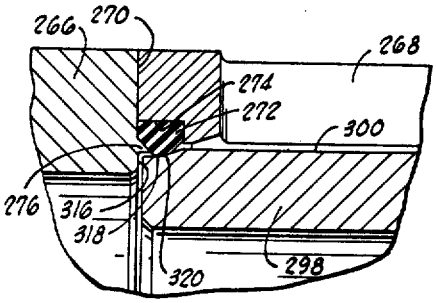

The dump valve DV, illustrated in FIG. 8, comprises a generally rectangularly shaped valve body 500. The valve body 510 includes a longitudinal passageway 502 extending therethrough and communicating with the first end portion 504 and the second end portion 506 of the valve body 500. One side 508 of the valve body 500 is provided with a machined surface for purposes which will be described in detail hereinafter.

The passageway 502 includes a first counterbore 510 formed therein from the first end portion 504. The first counterbore 510 forms an annular shoulder 512 which extends radially inwardly from the cylindrical wall of the counterbore 510. The diameter of the first counterbore 510 is preferably approximately 1⅞ inches.

A second counterbore 514 is formed in the passageway 502 from the first end portion 504 with the cylindrical surface thereof communicating with the cylindrical surface of the first counterbore 510 by means of an interconnecting tapered annular surface 516. The diameter of the second counterbore 514 is preferably approximately 2 inches.

The passageway 502 further includes a third counterbore 518 communicating with the first end portion 504 of the valve body 500. The passageway 502 also includes an internally threaded portion 520 which extends between and interconnects the second and third counterbore 514 and 518.

A fourth counterbore 522 is formed in the passageway 502 from the second end portion 506 of the valve body 500. An annular shoulder 524 extends radially inwardly from an annular relief groove 526 preferably formed in the cylindrical surface of the fourth counterbore 522 adjacent to the annular shoulder 524. The diameter of the cylindrical surface of the fourth counterbore 522 is preferably approximately 2 inches.

The passageway 502 further includes an internally threaded portion 528 extending from the second end portion 506 of the valve body 500 to an annular relief groove 530 which is in turn connected to the cylindrical surface of the fourth counterbore 522 by an annular shoulder 532.

A seal bushing 534 is positioned within the first counterbore 510 with one end face 536 thereof abutting the annular shoulder 512. A fluid tight seal is formed between the seal bushing 534 and the cylindrical surface of the first counterbore 510 by a pair of O-rings 538 disposed in respective annular grooves formed in the substantially cylindrical periphery of the seal bushing 534. A longitudinal bore 540 extends through the seal bushing 534 intersecting the one end face 536 and the opposite end face 542 thereof. A plurality of radially extending ports or apertures 544 communicate between the bore 540 and an annular groove 546 formed in the cylindrical periphery of the seal bushing 534 intermediate the O-rings 538.

A seat spacer 548 is positioned within a portion of the first counterbore 510 and a portion of the second counterbore 514 with the first end face 550 thereof abutting the second end face 542 of the seal bushing 534. The seat spacer 548 includes a circumferential groove 554 formed in the outer periphery thereof intermediate the first end face 550 and the second end face 556 thereof. A longitudinal bore 558 is formed in the seat spacer 548 and intersects the opposite end faces 550 and 556 thereof. The bore 558 has a diameter greater than the bore 540 through the seal bushing 534. At least one port 560 is formed in the seat spacer 548 and communicates between the bore 558 and the circumferential groove 554.

A generally cylindrically shaped carbide valve seat 562 is positioned within the second counterbore 514 with the inner end face 564 thereof abutting the second end face 556 of the seat spacer 548. The valve seat 562 includes a longitudinal bore 566 extending therethrough with a frusto-conical seating surface 568 formed thereon and interconnecting the bore 566 and the inner end face 564 thereof. A fluid tight seal is formed between the valve seat 562 and the cylindrical surface of the second counterbore 514 by an O-ring 570 disposed in an annular groove formed in the cylindrical surface of the counterbore 514.

An externally threaded seat retainer bushing 572 is threadedly engaged with the internally threaded portion 520 of the valve body 500 with the inner end face 574 thereof abutting the outer end face 576 of the valve seat 562. This positioning of the seat retainer bushing 572 within the valve body 500 secures the valve seat 562, seat spacer 548 and the seal bushing 534 within the passageway 502. A fluid tight seal is achieved between the seat retainer bushing 572 and the valve body 500 by an O-ring 578 disposed in an annular groove formed in the seat retainer bushing and sealingly engaging the cylindrical surface of the third counterbore 518. A longitudinal bore 580 is formed in the seat retainer bushing 572 and communicates between the inner end face 574 and the outer end face 582 thereof. The longitudinal bore 580 includes an internally threaded portion 584 formed therein adjacent to the outer end face 582.

A piston 586 is slidably disposed within a longitudinal passageway 502. The piston 586 includes a cylindrically shaped valve member end portion 588, having a diameter of approximately 1 inch, and a cylindrically shaped pilot piston end portion 590, having a diameter of approximately 2 inches. The valve member end portion 588 is longitudinally slidably disposed in the longitudinal bore 540 of the seal bushing 534 along the longitudinal axis thereof. A fluid tight sliding seal is provided between the valve member end portion 588 and the longitudinal bore 540 by means of a pair of T-rod seals 592 carried in respective annular grooves formed in the cylindrical surface of the bore 540 on opposite sides of the ports 544.

A frusto-conical sealing surface 592 is formed on the valve member end portion 588 and is sized and shaped to sealingly engage the mating frusto-conical seating surface 568 of the carbide valve seat 562 upon the abutment of the seating surfaces 592 and 568.

The pilot piston end portion 590 of the piston 586 is slidably disposed within the fourth counterbore 522. A fluid tight sliding seal is achieved between the pilot piston end portion 590 and the cylindrical surface of the fourth counterbore 522 by means of a T-rod seal 594 disposed in an annular groove formed in the cylindrical surface of the fourth counterbore 522.

A pilot cover 596 is threadedly secured within the internally threaded portion 528 of the valve body 500. The pilot cover includes a longitudinal passageway 598 extending therethrough with a counterbore 600 formed therein intersecting the inner end face 602 of the pilot cover 596. An internally threaded portion 604 is formed in the passageway 598 communicating between the outer end face 606 and the counterbore 600 of the pilot cover 596.

A cylindrically shaped pilot stem 608, having a diameter of approximately 1 inch, is slidably disposed within the counterbore 600 of the pilot cover 596. A fluid tight sliding seal is provided between the pilot stem 608 and the cylindrical surface of the counterbore 600 by means of a T-rod seal 610 carried in an annular groove formed in the cylindrical surface of the counterbore 600. The inner end face 612 of the pilot stem 608 is engageable with the outer end face 614 of the pilot piston end portion 590 of the piston 586 in abutting relation.

A vent port 616 is formed in the valve body 500 and communicates between the annular relief groove 530 and the exterior thereof. A second vent port 618 is formed in the valve body 500 and communicates between the cylindrical surface of the first counterbore 510 adjacent to the annular groove 546 of the seal bushing 534 and the exterior of the valve body 500.

A valve actuating pilot port 620 is formed in the valve body 500 and communicates between the exterior of the valve body 500 and the passageway 502 intermediate the annular shoulders 512 and 524 thereof. The valve actuating pilot port 620 includes an internally threaded portion 622.

A power fluid output port 624 is formed in the valve body 500 and communicates between the one side 508 and the second counterbore 514 intermediate the seal bushing 534 and the valve seat 562. The port 624 provides fluid communication with the port 560 and the longitudinal bore 558 of the seat spacer 548.

A mount spacer 626 having a bore 628 therethrough is positioned in engagement with the one side 508 of the valve body 500 with the bore 628 thereof in alignment with the output port 524. A fluid tight seal is provided between the mount spacer 626 and the side 508 of the valve body 500 by means of an O-ring 630 disposed in an annular groove formed in the mount spacer 626 concentric with the bore 628 therethrough. A second O-ring 632 is disposed in another annular groove formed in the mount spacer 626 concentric with the opposite end of the bore 628 to provide fluid tight sealing engagement of the dump valve DV with a suitable manifold. The dump valve DV is securable to a suitable manifold by means of a plurality of threaded screws 634 extending through apertures (not shown) formed in the valve body 500 and the mount spacer 626 to be threadedly received in a suitable manifold (not shown). In the present invention, the dump valve DV is secured to the exhaust manifold 238 interconnecting the adjacent exhaust ports 112 of the control valves 2-CV and 3-CV.

In operation, a constant control fluid closing pilot pressure of approximately 2000 psi is introduced through the longitudinal passageway 598 of the pilot cover 596 to act on the pilot stem 608, thereby urging the pilot stem 608 and the piston 586 to the left within the housing 500. This application of control fluid pressure constantly biases the seating surface 592 of the valve member end portion 588 into sealing engagement with the seating surface 568 of the valve seat 562. The longitudinal bore 580 of the seat retaining bushing 572 is in fluid communication with the power fluid at the rod ends of the three power cylinders 40. When a pilot pressure of predetermined magnitude is introduced into the valve actuating pilot port 620, the constant closing pressure on the piston 586 is overcome and the pilot pressure acting on the pilot piston end portion 590 at its connection with the valve member end portion 588 moves the piston 586 to the right within the valve body 500 unseating the seating surfaces 568 and 592 thereby opening the dump valve DV. At this time power fluid is allowed to flow through the longitudinal bore 580 and out through the output port 624 and bore 628 of the mount spacer 626 via the longitudinal bore 566, the longitudinal bore 558 and the port 560 of the dump valve DV.

The Pumping Cycle

The power fluid and control fluid circuits of the present invention are illustrated schematically in FIGS. 10A1, 10A2, 10B1, 10B2, 10C1, 10C2, 10D1, 10D2, 10E1 and 10E2 of the drawing.

Figure 10A:
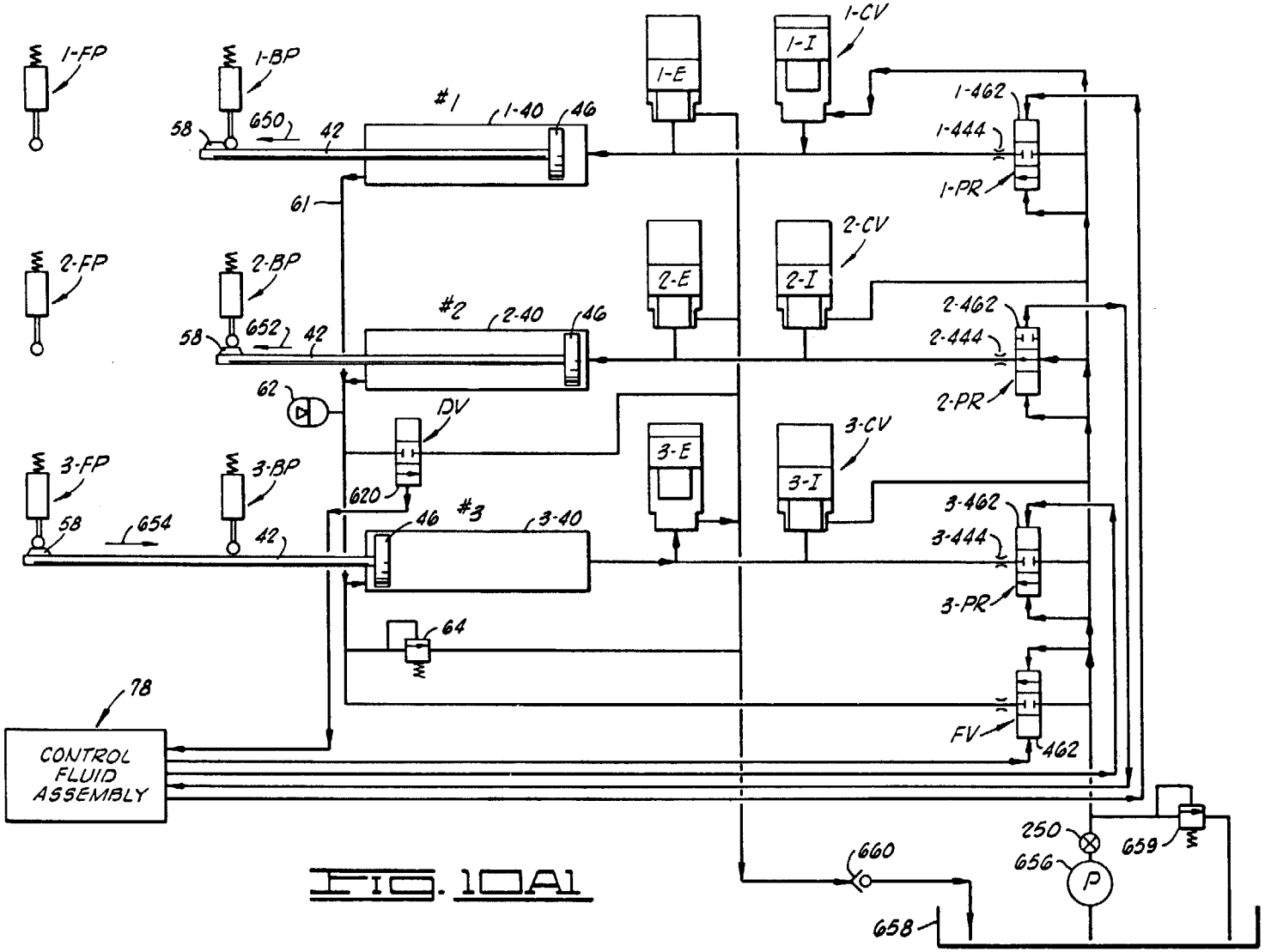

Referring now to FIGS. 10A1 and 10A2 and to Table 1 below, a first phase of the pumping cycle will be explained. In this phase, the power cylinder 1–40 is in the discharge stage of the cycle while the 2–40 and the 3–40 power cylinders are respectively in the precompression and suction stages. Movement of the piston rod assemblies 42 associated with these cycle stages is indicated by the arrows 650, 652 and 654.

In order for the 1–40 power cylinder to perform its discharging function, the 1-I sleeve valve must be open while the 1-E sleeve valve is in a closed position. In other words, the sleeve of the 1-I valve is in its upper position, and the sleeve of the 1-E valve is in its lower position as shown in FIG. 10A1.

Thus, with the sleeve valves 1-I and 1-E in the illustrated positions, power fluid provided by a power circuit pump 656 passes through the 1-I valve into the longitudinal bore 1-92 of the 1-CV control valve assembly. This pressurized fluid is prevented from passing through the closed 1-E valve so that it is caused to flow to the 1-40 power cylinder along the flow path indicated by the arrows in FIG. 10A1.

During the discharging function of the 1-40 power cylinder, fluid displaced from the rod end of that cylinder enters into the rod end of the 3–40 power cylinder through the common conduit 61. The pressure of this power fluid entering the rod end of the 3–40 power cylinder causes this cylinder to undergo the major portion of its suction function.

Performance of the suction function by the 3–40 power cylinder is permitted by the relative positions of the sleeve valves 3-I and 3-E in the 3-CV control valve assembly. As indicated in FIG. 10A1, the 3-I valve is in its lower or closed position, while the 3-E valve is in its upper or open position.

Because of the closed 3-I valve, pressurized fluid provided by the power circuit pump 656 via the open shut off valve assembly 250 is prevented from entering the longitudinal bore 3-92 of the 3-CV control valve assembly. Thus, this pressurized fluid does not resist displacement of power circuit fluid out of the 3–40 power cylinder by the power piston 36 thereof. The open 3-E valve permits this displaced power fluid to pass through the longitudinal bore 3-92 of the control valve assembly 3-CV, and thereafter through the 3-E valve to the power circuit reservoir or sump 658 via the check valve 660 as indicated by the arrows in FIG. 10A1. It should be noted that a pressure relief valve 659 is connected between the high pressure side of the pump 656 and the reservoir 658 to vent pressurized power fluid to the reservoir in the event the power fluid pressure exceeds a predetermined value. As an alternative, the pressure relief valve 659 may be vented to the atmosphere if loss of a small amount of power fluid is not critical to the operation of the pump.

As illustrated in FIG. 10A1, the 2-PR valve is in an open position so that pressurized power fluid provided by the power circuit pump 656 is directed to the 2–40 power cylinder through the orifice 2-444 along the flow path indicated by the arrows. This relatively small flow of power fluid causes the piston 46 of the power cylinder 3-40 to move toward the pump fluid end in the direction of the arrow 652 thereby forcing the fluid end piston slowly into the fluid end cylinder to precompress fluid within that cylinder to a pressure approaching discharge pressure.

The closed 2-I valve prevents discharge instigating flow of pressurized power fluid to th 2-40 power cylinder assembly. Further, the closed 2-E valve prevents the exhausting of precompression fluid to the power circuit reservoir 658.

It should be noted that the 3-PR precompression valve remains in a closed position throughout the cycle phase illustrated in FIG. 10A1 and the 1-PR precompression valve assumes a closed position in that cycle phase because pilot pressure exists on these valves at the pilot ports 3-462 and 1-462. The pilot pressure applied to the pilot ports 1-462 and 3-462 emanates from the control fluid assembly 78 as more clearly illustrated in FIG. 10A2, the function of which will be described in more detail hereinafter.

The pilot port 2-462 of the open precompression valve 2-PR communicates with the flow control fluid assembly 78 and is depressured or tanked thereby in a manner as will be described more fully hereinafter.

A summary of the sleeve valve and precompression valve positions associated with the cycle functions of the power cylinders, as illustrated in FIG. 10A1, will be found in Table 1. In Table 1, the symbol "U" indicates an untripped front position valve FP or back position valve BP, while the symbol "T" indicates a tripped front position valve FP or back position valve BP. The other terms used in Table 1 are believed to be self-explanatory when interpreted in conjunction with the schematic drawings to which the table applies.

TABLE 1

| | VALVE CONDITION | | | | |
|---|---|---|---|---|---|
| | FIGS. 10A1 & 10A2 | FIGS. 10B1 & 10B2 | FIGS. 10C1 & 10C2 | FIGS. 10D1 & 10D2 | FIGS. 10E1 & 10E2 |
| 1-FP | U | T | U | U | U |
| 2-FP | U | U | T | U | U |
| 3-FP | T | U | U | T | T |
| 1-BP | U | U | T | U | T |
| 2-BP | T | U | U | U | T |
| 3-BP | U | T | U | U | U |
| 1-FW | Up | Down | Up | Up | Up |
| 2-FW | Up | Up | Down | Up | Up |
| 3-FW | Down | Up | Up | Down | Down |
| 1-I | Open | Closed | Closed | Open | Open |
| 1-E | Closed | Open | Closed | Closed | Closed |
| 1-PR | Closed | Closed | Open | Closed | Closed |
| 2-I | Closed | Open | Closed | Closed | Closed |
| 2-E | Closed | Closed | Open | Closed | Closed |
| 2-PR | Open | Closed | Closed | Closed | Open |
| 3-I | Closed | Closed | Open | Closed | Closed |
| 3-E | Open | Closed | Closed | Open | Open |
| 3-PR | Closed | Open | Closed | Closed | Closed |
| FV | Closed | Closed | Closed | Open | Closed |
| DV | Closed | Closed | Closed | Closed | Open |

With reference to Table 1, it may be readily seen that a suction function is associated with a closed I valve and and open E valve whereby the appropriate longitudinal bore 92 of one control valve assembly CV is placed in communication with the power circuit reservoir 658. Further, a discharge function is associated with an open I valve and a closed E valve whereby the longitudinal bore 92 is maintained in communication with the power circuit pump 656. In both the discharge and suction functions, the associated precompression valve PR is closed.

The precompression function is associated with a control valve assembly condition wherein both the I and E valves are closed and the associated precompression valve Pk is moved from its normally closed position to an open position, thus providing a restrictive flow of power fluid to the associated power cylinder assembly through the appropriate longitudinal bore 92.

Referring now to FIG. 10A2 and to table 1, the function of the control circuit conditioning valves 1-FP, 2-FP and 3-FP will be described in connection with the positioning of the I and E valves o the control valve assemblies CV as previously explained in the discussion of FIG. 10A1.

In FIG. 10A2 the final positions of the I and E valves associated with the phase of the pumping cycle described in connection with FIG. 10A1 are clearly illustrated. The positions of the I and E valves immediately preceding this phase of the pumping cycle as illustrated in FIG. 10C1 and FIG. 10C2.

With reference to FIG. 10A2 it will be apparent that the 1-CV control valve assembly is in condition for the illustrated phase of the pumping cycle by movement of the 1-I valve from its lower or closed position to its upper or open position. The opening of the 1-I valve is caused by the position of the 3-FP front position valve. The 3-FP valve is so positioned by actuation thereof by the cam actuator 58 of power cylinder 3-40. With the 3-FP front position valve in the tripped position, pressurized control fluid is directed therethrough from the pump assembly 80 through the 2-DPC and 3-DPC double piloted check valves to properly condition and lock the 2-FW and 3-FW four way position valves. The 2-FW four way position valve is actuated to its up position and the 3-FW four way position valve is actuated to its down position. Pressurized control fluid from the pump 80 is directed through the 2-FW valve and through shuttle valve 662 to the pilot port 1-462 of the precompression valve 1-PR. Control fluid through the 2-FW valve is further directed through the tripped 2-BP valve and shuttle valves 664 and 666 to the pilot port 462 of the fill valve FV thereby retaining the fill valve in a closed position.

Pressurized control fluid from the pump 80 also flows through the 3-FW valve to the I-B port of the control valve assembly 1-CV and to the E-B port of the control valve 3-CV through piloted check valve 670. Pressurized control fluid also flows from the pump 80 through the 3-FW valve to the pilot port of the piloted check valve 672.

As a result of the expansion of the control fluid in the B chamber of the 1-I valve, the A chamber thereof contracts displacing control fluid through the I-A port of the 1-I valve to the I-A port of the 3-I valve through piloted check valves 672 and 674. As a result of the expansion of the A chamber of the 3-I valve, the B chamber thereof contracts displacing control fluid through the I-B port thereof and back to the control fluid reservoir assembly 82 via the 2-FW valve. When the 3-I valve reaches its down or closed position, the I-C port thereof is placed in fluid communication with the piloted check valve 670 thereby unseating the piloted check valve 670 and allowing the previously mentioned control fluid flow therethrough from the 3-FW valve to the E-B port of the 3-E valve.

As a result of the expansion of the B chamber of the 3-E valve, the A chamber thereof contracts displacing control fluid through the E-A port of the 3-E valve and into the E-A port of the 2-E valve thereby closing the 2-E valve. As a result of the expansion of the A chamber of the 2-E valve, the B chamber thereof contracts displacing control fluid through the E-B port thereof through piloted check valve 676 back to the control fluid reservoir assembly 82 via the 2-FW valve. The control fluid pilot volume from the piloted check valve 678 flows back to the control fluid reservoir assembly 82 via check valve 680 and the 3-FW valve.

As previously mentioned, pressurized control fluid passes through the tripped 2-BP back position valve to apply pilot pressure to the pilot port 462 of the fill valve FV to retain the fill valve in a closed position. The 2-BP back position valve is positioned in its tripped position by the cam actuator 58 of the 2-40 power cylinder while it is in the precompression phase. This conditioning of the 2-BP back position valve permits the pilot port 2-462 of the precompression valve 2-PR to communicate therethrough via shuttle valve 682 with the control fluid reservoir assembly 82 thereby releasing pilot pressure on and permitting the opening of the precompression valve 2-PR.

It will also be seen that the four way position valve 1-FW remains in its up position from the next preceding phase of the pumping cycle thereby allowing pressurized control fluid flow therethrough to the pilot port 3-462 of the precompression valve 3-PR via the shuttle valve 684 thereby retaining the precompression valve 3-PR in a closed condition.

The pilot port 62D of the dump valve DV is in fluid communication with the control fluid reservoir assembly 82 via shuttle valves 686 and 688, piloted check valve 690 and the back position valve 1-BP thereby retaining the dump valve DV in its closed position.

Referring now to FIGS. 10B1 and 10B2 and to Table 1, the second phase of the pumping cycle will be explained. In this phase, the power cylinder 2-40 is in the discharge stage of the cycle while the power cylinders 3-40 and 1-40 are respectively in the precompression and suction stages. Movement of the piston rod assemblies 42 associated with these cycle stages is indicated by the arrows 692, 694 and 696.

In order for the power cylinder 2-40 to perform its discharging function, the 2-I sleeve valve must be open while the 2-E sleeve valve is in the closed position. In other words, the sleeve of the 2-I valve is in its upper position, and the sleeve of the 2-E valve is in its lower position as shown in FIG. 10B1.

Thus, with the sleeve valves 2-I and 2-E in the illustrated positions, power fluid provided by the power circuit pump 656 passes through the 2-I valve into the longitudinal bore 2-92 of the 2-CV control valve assembly. The pressurized power fluid is prevented from passing through the closed 2-E valve so that it is caused to flow to the power cylinder 2-40 along the flow path indicated by the arrows in FIG. 10B1.

During the discharging function of the 2-40 power cylinder, fluid displaced from the rod end of that cylinder enters into the rod end of the 1-40 power cylinder through the common conduit 61. The pressure of this power fluid entering the rod end of the power cylinder 1-40 causes this cylinder to undergo the major portion of its suction function.

Performance of the suction function by the 1-40 power cylinder is permitted by the relative positions of the sleeve valves 1-I and 1-E in the 1-CV control valve assembly. As indicated in FIG. 10B1, the 1-I valve is in its lower or closed position, while the 1-E valve is in its upper or open position.

Because of the closed 1-I valve, pressurized power fluid provided by the power circuit pump 656 is prevented from entering the longitudinal bore 1-92 of the 1-CV control valve assembly. Thus, the pressurized power fluid does not resist displacement of power circuit fluid out of the power cylinder 1-40 by the power piston 46 thereof. The open 1-E valve permits the displaced power fluid to pass through the longitudinal bore 1-92 of the control valve assembly 1-CV, and thereafter through the 1-E valve to the power circuit reservoir 658 via the check valve 660 as indicated by the arrows in FIG. 10B1.

As also illustrated in FIG. 10B1 the 3-PR valve is in an open position so that the pressurized fluid provided by the power circuit pump 656 is directed to the power cylinder 3-40 through the orifice 3-444 along the flow path indicated by the arrows. This relatively restricted flow of pressurized power fluid causes the piston 46 of the power cylinder 3-40 to move toward the pump fluid end in the direction of the arrow 696 thereby forcing the fluid end piston slowly into the fluid end cylinder to precompress fluid within that cylinder to a pressure approaching discharge pressure.

The closed 3-I valve prevents discharge instigating flow of pressurized power fluid to the power cylinder assembly 3-40. Further, the closed 3-E valve prevents the exhausting of precompression fluid to the power circuit reservoir 658.

It should be noted that the 1-PR precompression valve remains in a closed position throughout the cycle phase illustrated in FIG. 10B1 and the 2-PR precompression valve assumes a closed position in that cycle phase because pilot pressure exists on these valves at the pilot ports 1-462 and 2-462. The pilot pressure applied to the pilot ports 1-462 and 2-462 emanates from the control fluid assembly 78 as more clearly illustrated in FIG. 10B2, the function of which will be described in detail hereinafter.

The pilot port 3-462 of the open precompression valve 3-PR communicates with the flow control fluid assembly 78 and is depressured or tanked thereby in a manner as will be described more fully hereinafter.

A summary of the sleeve valve and precompression valve positions associated with the cycle functions of the power cylinders, as illustrated in FIG. 10B1, will be found in Table 1.

Referring now to FIGS. 10B2 and to Table 1, the function of the control circuit conditioning valves 1-FP, 2-FP and 3-FP will be described in connection with the positioning of the I and E valves of the control valve assemblies CV as previously explained in the discussion of FIG. 10B1.

In FIG. 10B2 the final positions of the I and E valves associated with the phase of the pumping cycle described in connection with FIG. 10B1 are clearly illustrated. The positions of the I and E valves immediately preceding this phase of the pumping cycle are illustrated in FIG. 10A1 and FIG. 10A2.

With reference to FIG. 10B2 it will be apparent that the 2-CV control valve assembly is in condition for the illustrated phase of the pumping cycle by movement of the 2-I valve from its lower or closed position to its upper or open position. The opening of the 2-I valve is caused by the position of the 1-FP front position valve. The 1-FP valve is so positioned by actuation thereof by the cam actuator 58 of the 1-40 power cylinder. With the 1-FP front position valve in a tripped position, pressurized control fluid is directed therethrough from the pump assembly 80 through the 1-DPC and 3-DCP double piloted check valves to properly condition and lock the 1-FW and 3-FW four way position valves. The 1-FW four way position valve is actuated to its down position and the 3-FW four way position valve is actuated to its up position. Pressurized control fluid from the pump 80 is directed through the 3-FW valve through shuttle valve 682 to the pilot port 2-462 of the precompression valve 2-PR. Control fluid through the 3-FW valve is further directed through the tripped 3-BP valve and the shuttle valve 666 to the pilot port 462 of the fill valve FV thereby retaining the fill valve in its closed position Pressurized control fluid from the pump 80 also flows through the 1-FW valve to the 1-B port of the control valve assembly 2-CV and to the E-B port of the control valve 1-CV through the piloted check valve 678. Pressurized control fluid also flows from the pump 80 through the 1-FW valve to the pilot port of the piloted check valve 698.

As a result of the expansion of the control fluid in the B chamber of the 2-1 valve, the A chamber thereof contracts displacing control fluid through the 1-A port of the 2-1 valve to the 1-A port of the 1-1 valve through the piloted check valves 698 and 672. As a result of the expansion of the A chamber of the 1-1 valve, the B chamber thereof contracts displacing control fluid through the 1-B port thereof and back to the control fluid reservoir assembly 82 via the 3-FW valve. When the 1-1 valve reaches its down or closed position, the I-C port thereof is placed in fluid communication with the piloted check valve 678 thereby unseating the piloted check valve 678 and allowing the previously mentioned control fluid flow therethrough from the 1-FW valve to the E-B port of the 1-E valve.

As a result of the expansion of the B chamber in the 1-E valve, the A chamber thereof contracts displacing control fluid through the E-A port of the 1-E valve into the E-A port of the 3-E valve thereby closing the 3-E valve. As a result of the expansion of the A chamber of the 3-E valve, the B chamber thereof contracts displacing control fluid through the E-B port thereof through piloted check valve 670 back to the control reservoir assembly 82 via the 3-FW valve. The control fluid pilot volume from the piloted check valve 676 flows back to the control fluid reservoir assembly 82 via check valve 700 and the 1-FW valve.

As previously mentioned, pressurized control fluid passes through the tripped 3-BP back position valve to apply pilot pressure to the pilot port 462 of the fill valve FV to retain the fill valve in a closed position. The 3-BP back position valve is positioned in its tripped position by the cam actuator 58 of the 3-40 power cylinder while it is in the precompression phase. This conditioning of the 3-BP back position valve permits the pilot port 3-462 of the precompression valve 3-PR to communicate therethrough via shuttle valve 684 with the control fluid reservoir assembly 82 thereby releasing pilot pressure on and permitting the opening of the precompression valve 3-PR.

It will also be seen that the four way position valve 2-FW remains in its up position from the next preceding phase of the pumping cycle thereby allowing pressurized control fluid therethrough to the pilot port 1-462 of the precompression valve 1-PR via the shuttle valve 662 thereby retaining the precompression valve 1-PR in a closed position.

The pilot port 620 of the dump valve DV is in fluid communication with the control fluid reservoir assembly 82 via shuttle valves 686 and 688, piloted chack valve 702 and the back position valve 2-BP thereby retaining the dump valve DV in its closed position.

Referring now to FIGS. 10C1 and 10C2 and Table 1, a third phase of the pumping cycle will be explained. In this phase, the power cylinder 3-40 is in the discharge stage of the cycle while the 1-40 and 2-40 power cylinders are respectively in the precompression and suction stages. The movement of the piston rod assemblies 42 associated with these cycle stages is indicated by the arrows 704, 706 and 708.

In order for the power cylinder 3-40 to perform its discharging function, the 3-I sleeve valve must be open while the 3-E sleeve valve is in a closed position. In other words, the sleeve of the 3-I valve is in its upper position, and the sleeve of the 3-E valve is in its lower position as shown in FIG. 10C1.

Thus with the sleeve valves 3-I and 3-E in the illustrated positions, power fluid provided by the power circuit pump 656 passes through the 3-I valve into the longitudinal bore 3-92 of the 3-CV control valve assembly. This pressurized fluid is prevented from passing through the closed 3-E valve so that it is caused to flow to the 3-40 power cylinder along the flow path indicated by the arrows in FIG. 10C1.

During the discharging function of the power cylinder 3-40, fluid displaced from the rod end of that cylinder enters into the rod end of the power cylinder 2-40 through the common conduit 61. The pressure of this power fluid entering the rod end of the 2-40 power cylinder causes this cylinder to undergo the major portion of its suction function.

Performance of the suction function by the 2-40 power cylinder is permitted by the relative postions of the sleeve valves 2-I and 2-E in the 2-CV control valve assembly. As indicated in FIG. 10C1, the 2-I valve is in its lower or closed position, while the 2-E valve is in its upper or open position.

Because of the closed 2-I valve, pressurized fluid provided by the power circuit pump 656 is prevented from entering the longitudinal bore 2-92 of the 2-CV control valve assembly. Thus, this pressurized fluid does not resist displacement of power circuit fluid out of the power cylinder 2-40 by the power piston 46 thereof. The open 2-E valve permits this displaced power fluid to pass through the longitudinal bore 2-92 of the control valve assembly 2-CV, and thereafter through the 2-E valve to the power circuit reservoir 658 via the check valve 660 as indicated by the arrows in FIG. 10C1.

As illustrated in FIG. 10C1, the 1-PR precompression valve is in an open position so that pressurized power fluid provided by the power circuit pump 656 is directed to the power cylinder 1-40 through the orifice 1-444 along the flow path indicated by the arrows. This relatively small restricted flow of power fluid causes the piston 46 of the power cylinder 1-40 to move toward the pump fluid end in the direction of the arrow 704 thereby forcing the fluid end piston slowly into the fluid end cylinder to precompress fluid within that cylinder to a pressure approaching discharge pressure.

The closed 1-I valve prevents discharge instigating flow of pressurized power fluid to the 1-40 power cylinder assembly. Further, the closed 1-E valve prevents the exhausting of precompression fluid to the power circuit reservoir 658.

It should be noted that the 2-PR precompression valve remains in a closed position throughout the cycle phase illustrated in FIG. 10C1 and the 2-PR precompression valve assumes a closed position in that cycle phase because pilot pressure exists on these valves at the pilot ports 2-462 and 3-462. The pilot pressure applied to the pilot ports 2-462 and 3-462 emanates from the control fluid assembly 78 as more clearly illustrated in FIG. 10C2, the function of which will be described in more detail hereinafter.

The pilot port 1-462 of the open precompression valve 1-PR communicates with the flow control fluid assembly 78 and is depressured or tanked thereby in a manner as will be described more fully hereinafter.

A summary of the sleeve valve and precompression valve positions associated with the cycle functions of the power cylinders, as illustrated in FIG. 10C1, will be found in Table 1.

Referring now to FIG. 10C2 and the Table 1, the function of the control circuit conditioning valves 1-FP, 2-FP and 3-FP will be described in connection with the positioning of the I and E valves of the control valve assemblies CV as previously explained in the discussion of FIG. 10C1.

In FIG. 10C2 the final positions of the I and E valves associated with the phase of the pumping cycle described in connection with FIG. 10C1 are clearly illustrated. The positions of the I and E valves immediately preceding this phase of the pumping cycle are illlustrated in FIG. 10B1 and FIG. 10B2.

With reference to FIG. 10C2 it will be apparent that the 3-CV control valve assembly is in condition for the illustrated phase of the pumping cycle by movement of the 3-I valve from its lower or closed position to its upper or open position. The opening of the 3-I valve is caused by the position of the 2-FP front position valve. The 2-FP valve is also positioned by actuation thereof by the cam actuator 58 of the power cylinder 2-40. With the 2-FP front position valve in the tripped position, pressurized control fluid is directed therethrough from the pump assembly 80 through the 1-DPC and 2-DPC double piloted check valves to properly condition and lock the 1-FW and 2-FW four way position valves. The 1-FW four way position valve is actuated to its up position and the 2-FW four way position valve is actuated to its down position. Pressurized control fluid from the pump 80 is directed through the 1-FW valve and through shuttle valve 684 to the pilot port 3-462 of the precompression valve 3-PR. Control fluid through the 1-FW valve is further directed through the tripped 1-BP valve and shuttle valves 664 and 666 to the pilot port 462 of the fill valve FV thereby retaining the fill valve in a closed position.

Pressurized control fluid from the pump 80 also flows through the 2-FW valve to the pilot port of the piloted check valve 674 and the I-B port of the control valve assembly 3-CV and to the E-B port of the control valve assembly 2-CV through piloted check valve 676.

As a result of the expansion of the control fluid in the B chamber of the 3-I valve, the A chamber thereof contracts displacing control fluid through the I-A port of the 3-I valve to the I-A port of the 2-I valve through piloted check valves 674 and 698. As a result of the expansion of the A chamber of the 2-I valve, the B chamber thereof contracts displacing control fluid through the I-B port thereof and back to the control fluid reservoir assembly 82 via the 1-FW valve. When the 2-I valve reaches its down or closed position, the I-C port thereof is placed in fluid communication with the piloted check valve 676 thereby unseating the piloted check valve 676 and allowing the previously mentioned control fluid flow therethrough from the 2-FW valve to the E-B port of the 2-E valve.

As a result of the expansion of the B chamber of the 2-E valve, the A chamber thereof contracts displacing control fluid through the E-A port of the 2-E valve and into the E-A port of the 1-E valve thereby closing the 1-E valve. As a result of the expansion of the A chamber of the 1-E valve, the B chamber thereof contracts displacing control fluid through the E-B port thereof through piloted check valve 678 back to the control fluid reservoir assembly 82 via the 1-FW valve. The control fluid pilot volume from the piloted check valve 670 flows back to the control fluid reservoir assembly 82 via check valve 710 and the 2-FW valve.

As previously mentioned, pressurized control fluid passes through the tripped 1-BP back position valve to apply pilot pressure to the pilot port 462 of the fill valve FV to retain the fill valve in a closed position. The 1-BP back position valve is positioned in its tripped position by the cam actuator 58 of the power cylinder 1-40 while it is in the precompression phase. This conditioning of the 1-BP back position valve permits the pilot port 1-462 of the precompression valve 1-PR to communicate therethrough via shuttle valve 662 with the control fluid reservoir assembly 82 thereby releasing pilot pressure on and permitting the opening of the precompression valve 1-PR.

It will also be seen that the four way position valve 3-FW remains in its up position from the next preceding phase of the pumping cycle thereby allowing pressurized control fluid flow therethrough to the pilot port 2-462 via the shuttle valve 682 thereby retaining the precompression valve 2-PR in a closed condition.

The pilot port 620 of the dump valve DV is in fluid communication with the control fluid reservoir assembly 82 via shuttle valve 686, piloted check valve 712 and the back position valve 3-BP thereby retaining the dump valve DV in its closed position.

Referring now to FIGS. 10D1 and 10D2 there is illustrated schematically therein a variation of the first phase of the pumping cycle previously discussed and illustrated in FIG. 10A1 and 10A2. In FIG. 10D1 it will be seen that the cam actuator 58 of the power cylinder 2-40 is not in contact with the back position valve 2-BP thereby placing the 2-BP valve in an untripped condition. This condition occurs when there is an inadequate volume of powder fluid in the rod ends of the three power cylinders 40 and the common conduit 61. The system senses this condition and causes the fill valve FV to open thereby providing supplementary power fluid to the rod ends of the power cylinders 40 and to the common conduit 61.

Referring to FIG. 10D2 it will be seen that when the back position valve 2-BP is in an untripped position, pressurized control fluid communicates between the pump assembly 80 and the pilot port 2-462 of the precompression valve 2-PR via the 2-FW valve, the untripped back position valve 2-BP and the shuttle valve 682 thereby placing the precompression valve 2-PR in a closed position preventing power fluid flow therethrough.

It will also be seen that the untripped back position valve 2-BP places the pilot port 462 of the fill valve FV in communication with the control fluid reservoir 82 via the shuttle valves 666 and 664 thereby placing the fill valve FV in an open position so that supplementary power fluid passes therethrough to the rod ends of the power cylinders 40 from the power circuit pump 656. The pump system will continue its operation in this phase of the pumping cycle until the next phase of the cycle, described above and illustrated in FIGS. 10B1 and 10B2, is initiated at which time the fill valve FV will be closed if the proper amount of makeup power fluid has been passed therethrough to achieve the normal conditions illustrated in FIGS. 10B1 and 10B2.

Referring now to FIGS. 10E1 and 10E2 and to Table 1, another variation of the basic cycle illustrated in FIGS. 10A1 and 10A2 is shown wherein the cam actuator 58 of the power cylinder 1-40 is actuating the back position valve 1-BP thereby placing the back position valve 1-BP in a tripped condition. This situation can occur when an excess amount of power fluid is present in the rod ends of the power cylinders 40 and in the common interconnecting conduit 61. When this condition exists, it will be seen in FIG. 10E2 that pressurized control fluid communicates between the control fluid pump assembly 80 and the pilot port 620 of the dump valve DV via the 1-FW valve, the back position valve 1-BP, the piloted check valve 690 and the shuttle valves 688 and 686. The pilot operated check valve 690 is unseated to allow such flow therethrough by means of the application of pressurized control fluid to the pilot port thereof from the control fluid pump assembly 80 via the 2-FW valve and the tripped back position valve 2-BP. When the dump valve DV is so actuated to its open position, power fluid is allowed to flow therethrough from the rod ends of the power cylinders 40 and the interconnecting common conduit 61 to the power circuit reservoir 658 via the check valve 650, as illustrated in FIG. 10E1. The pump system will continue operation in this particular phase of the pumping cycle until the next succeeding phase, described above and illustrated in FIGS. 10B1 and 10B2, is encountered at which time the pump system will have been correctly compensated and the proper amount of power fluid will be contained in the rod ends of power cylinders 40 and the interconnecting common conduit 61. The fill valve FV will then be closed as illustrated in FIGS. 10B1 and 10B2 and the pumping cycle will continue in a normal fashion.

It will be seen from the foregoing description of the pumping cycle of the present invention that an extremely reliable, self-compensating system comprising a separate fluid control assembly 78 in combination with an improved power end assembly 38 provides a pump 20 which constantly monitors its own operation during each phase of the pumping cycle.

It should also be noted that the cycle variation described and illustrated in FIGS. 10D1, 10D2, 10E1 and 10E2, while referring generally to the cycle phase described and illustrated in FIGS. 10A1 and 10A2, may also be encountered during the other two phases of a complete pump cycle. It is not believed, however, to be essential to a complet disclosure of the invention to describe all possible variations which may occur and be corrected by the control system during operation of the triplex pump. It will be readily apparent to those skilled in the art that the present pump and its associated control system provides capability for constantly monitoring and correcting operation of the pump to provide smooth and reliable service under virtually all circumstances.

Changes may be made in the arrangement or combination of parts or elements shown in the drawings and described in the specification without departing from the spirit and scope of the invention as defined in the following claims.

What is claimed is:

1. A hydraulically operated control valve assembly for use in controlling the application of presurized power fluid to a piston and cylinder pump having a power cylinder on one end and a fluid cylinder on the opposite end and a common piston rod assembly longitudinally movably received in the power cylinder and the fluid cylinder, the control valve assembly being of the type which includes:

a power fluid inlet valve body having power fluid entry and exit passages;

a power fluid exhaust valve body having power fluid entry and exit passages;

power fluid inlet sleeve valve means carried by said power fluid inlet valve body for providing selective communication between the power fluid entry passage and the power fluid exit passage of said power fluid inlet valve body;

power fluid exhaust sleeve valve means carried by said power fluid exhaust valve body for providing selective communication between the power fluid entry passage and the power fluid exit passage of said power fluid exhaust valve body;

the entry passage of said power fluid inlet valve body being in continuous communication with a source of pressurized power fluids;

the exit passage of said power fluid exhaust valve body being in continuous communication with a power fluid reservoir;

a common chamber in continuous communication with the power fluid entry passage of said power fluid exhaust valve body and the power fluid exit passage of said power fluid inlet valve body, said common chamber communicating with the power cylinder; and precompression valve means having a power fluid entry passage, a power fluid exit passage in continuous communication with said common chamber through power fluid flow reducing means, and the entry passage being in continuous communication with the source of pressurized power fluid and being in selected communication with said common chamber through the exit passage and the power fluid flow reducing means, for producing a limited precompression of power fluid in the power cylinder, in combination with the improvement comprising:

hydraulic control circuit means for providing hydraulic control of said precompression valve means independently of the power fluid, said hydraulic control circuit means including:

a source of pressurized hydraulic control fluid; said precompression valve means including a hydraulically operated valve member; and further including a hydraulic fluic control entry passage therein, said valve member selectively placing pressurized power fluid in communication with said common chamber and, alternately, for blocking such communication in response to the absence or presence of pressurized hydraulic control fluid at the hydraulic control fluid entry passage, respectively; and control valve means interposed between and in selective hydraulic communication with said cource of pressurized hydraulic control fluid and the control fluid entry passage of said hydraulically operated precompression valve means for alternately blocking and passing pressurized hydraulic control fluid therethrough in response to the position of the common piston and rod assembly of the piston and cylinder pump; and said hydraulic control fluid entry passage of said precompression valve means being continuously isolated from said source of pressurized power fluid and isolated from the power fluid exit passage of said precompression valve means.

2. The apparatus as defined in claim 1, wherein:

the common piston rod assembly of said piston and cylinder pump includes cam means for moving with said common piston rod assembly and for actuating said control valve means and thereby causing closure of said hydraulically operated valve member in said precompression valve means upon movement of said common piston rod assembly of said pump to a predetermined position relative to said power cylinder of said pump.

3. A fluid power pump for use with a source of pressurized power fluid, comprising in combination:

a piston and cylinder assembly having opposite ends with a power cylinder on one end and a fluid cylinder on the opposite end and a common piston rod assembly reciprocatingly received in the power cylinder and the fluid cylinder;

a control valve assembly including:

a power fluid inlet valve body having power fluid entry and exit passages;

a power fluid exhaust valve body having power fluid entry and exit passages;

power fluid inlet sleeve valve means disposed in said power fluid inlet valve body for providing and, alternately, blocking communication between the power fluid entry passage and the power fluid exit passage of said power fluid inlet valve body;

power fluid exhaust sleeve valve means disposed in said power fluid exhaust valve body for providing and, alternately, blocking communication between the power fluid entry passage and the power fluid exit passage of said power fluid exhaust valve body;

means in said power fluid inlet valve body for continuously commmunicating the entry passage thereof with the source of pressurized power fluid;

means in said power fluid exhaust valve body for continuously communicating the exit passage thereof with the source of pressurized power fluid;

common chamber means for continuously communicating the power fluid entry passage of said power fluid exhaust valve body, the power fluid exit passage of said power fluid inlet valve body, and the power fluid cylinder of said piston cylinder assembly; and precompression valve means having a power fluid entry passage, a power fluid exit passage in continuous communication with said common chamber means through means for reducing power fluid flow, the entry passage of said precompression valve means being in continuous communication with the source of pressurized power fluid and being in selective communication with said common chamber means through the exit passage and said means for reducing fluid flow, for producing a limited precompression of power fluid within the power cylinder of said piston and cylinder pump assembly;

hydraulic control circuit means for providing hydraulic control of said precompression valve means independently of the power fluid, said hydraulic control circuit means including:

means for providing a quantity of pressurized hydraulic control fluid independently of the power fluid; said precompression valve means including hydraulically operated valve member, and further, having a hydraulic control fluid entry passage therein, for selectively placing pressurized power fluid in communication with said common chamber means, and, alternately, for blocking communication between the pressurized power fluid and said common chamber means in response to the absence and, alternately, the presence of pressurized hydraulic control fluid at the hydraulic control fluid entry passage, respectively; and control valve means, interposed between and in selective hydraulic communication with said means for providing pressurized hydraulic control fluid and the control fluid entry passage of said hydraulically operated precompression valve means, for blocking and, alternately, passing pressurized hydraulic control fluid therethrough in response to the position of the common piston and rod assembly relative to the power cylinder and fluid cylinder of said piston and cylinder pump assembly; and said hydraulic control fluid entry passage of said precompression valve means being continuously isolated from the source of pressurized power fluid and continuously isolated from the power fluid exit passage of said precompression valve means.

4. The pump as defined in claim 3 wherein the common piston rod assembly of said piston and cylinder pump assembly is characterized further to include:

cam means for moving with said common piston rod assembly to selectively actuate said control valve means to thereby cause closure of said hydraulically operated valve member in said precompression valve means in response to movement of said common piston rod assembly to a predetermined position relative to said power cylinder of said piston and cylinder pump assembly.

* * * * *